US009878893B2

(12) United States Patent
Chen

(10) Patent No.: US 9,878,893 B2
(45) Date of Patent: Jan. 30, 2018

(54) WATER DISPENSER

(71) Applicant: Huang-Han Chen, New Taipei (TW)

(72) Inventor: Huang-Han Chen, New Taipei (TW)

( * ) Notice: Subject to any disclaimer, the term of this patent is extended or adjusted under 35 U.S.C. 154(b) by 1304 days.

(21) Appl. No.: 13/888,819

(22) Filed: May 7, 2013

(65) Prior Publication Data

US 2014/0027094 A1 Jan. 30, 2014

(30) Foreign Application Priority Data

Jul. 27, 2012 (TW) ..... 101214514 A
Oct. 8, 2012 (TW) ..... 101219465 A

(51) Int. Cl.
*F28F 7/00* (2006.01)
*B67D 3/00* (2006.01)
*F28F 3/04* (2006.01)
(Continued)

(52) U.S. Cl.
CPC ..... *B67D 3/0022* (2013.01); *F24D 17/0031* (2013.01); *F24D 17/0089* (2013.01);
(Continued)

(58) Field of Classification Search
CPC ..... B67D 3/022; B67D 3/0038; B67D 3/00; F24D 1/00
USPC ..... 237/59, 63
See application file for complete search history.

(56) References Cited

U.S. PATENT DOCUMENTS 4,765,351 A * 8/1988 Clary ..... A47L 15/4236 134/107
4,815,534 A * 3/1989 Fuerschbach ..... F28D 9/0075 165/166
(Continued)

FOREIGN PATENT DOCUMENTS

DE 202005013441 U1 11/2005
DE 102006033834 A1 1/2008
(Continued)

OTHER PUBLICATIONS

Serv.ip (a company of the Austrian Patent Office under private law), Search and Examination Report for Singapore application No. 201304603-2, dated Aug. 14, 2014.
(Continued)

*Primary Examiner* — Alissa Tompkins
*Assistant Examiner* — John Bargero
(74) *Attorney, Agent, or Firm* — Ming Chow; Sinorica, LLC

(57) ABSTRACT

A water dispenser including a heat-exchanger, a heater, a water-storage tank, and a faucet is provided mainly. The heat-exchanger has a first/second guiding-channel, a first inlet/outlet communicated with two ends of the first guiding-channel, and a second inlet/outlet communicated with two ends of the second guiding-channel. The water flows into the heat-exchanger through the first inlet, and flows out of the heat-exchanger through the first outlet. Two ends of the heater are communicated with the first outlet and the second inlet, and the water flowed out of the first outlet is heated by the heater. The heated water flows into the heat-exchanger through the second inlet, and flows out of the heat-exchanger through the second outlet. The water-storage tank is used to storage the water flowed out of the second outlet. The faucet is communicated with the water-storage tank and the heater respectively.

12 Claims, 17 Drawing Sheets

(51) Int. Cl.

| | |
|---|---|
| ***F24D 17/00*** | (2006.01) |
| ***F28F 3/08*** | (2006.01) |
| ***F24D 19/10*** | (2006.01) |
| ***F28F 13/12*** | (2006.01) |
| ***F28D 9/00*** | (2006.01) |
| ***F24H 1/12*** | (2006.01) |

(52) U.S. Cl.
CPC ..... *F24D 19/1051* (2013.01); *F24H 1/12* (2013.01); *F28D 9/0075* (2013.01); *F28F 3/04* (2013.01); *F28F 3/086* (2013.01); *F28F 13/12* (2013.01)

(56) References Cited

U.S. PATENT DOCUMENTS

| | | | | |
|---|---|---|---|---|
| 6,405,551 | B1 * | 6/2002 | Kuwabara | F24D 17/02 62/238.6 |
| 7,017,655 | B2 | 3/2006 | Wilson et al. | |
| 2004/0011514 | A1 * | 1/2004 | Holm | F28D 9/005 165/166 |
| 2010/0238757 | A1 * | 9/2010 | Capps | B01F 3/20 366/22 |

FOREIGN PATENT DOCUMENTS

| | | | |
|---|---|---|---|
| DE | 102011008762 | A1 | 7/2012 |
| EP | 0372293 | A2 | 6/1990 |
| GB | 2457164 | A | 8/2009 |

OTHER PUBLICATIONS

Intellectual Property Office of Singapore (IPOS), Acknowledgement and Receipt for GST Registration No. 200004489C, dated Jun. 14, 2013.

* cited by examiner

WATER DISPENSER

The current application claims foreign priorities to the patent application of Taiwan No. 101214514 filed on Jul. 27, 2012 and patent application of Taiwan No. 101219465 filed on Oct. 8, 2012.

BACKGROUND OF THE INVENTION

Field of the Invention

The invention relates to a water dispenser. More particularly, the invention relates to a water dispenser having a energy-saving effect.

Description of Related Art

Human body contains 70% of water, and people must drink suitable water amount one day to keep healthy. Otherwise, people may be sick or tired. It can be seen that drinking water is important to human. Therefore, water dispensers for providing water at normal temperature or hot water are installed for drinking whether at home or in the office. However, in order to provide hot water at any time, it must take power to keep the temperature of water. This will consumes power, and increases the cost significantly.

Further, in order to decrease power-consuming, a heat-exchanger such as U.S. Pat. No. 7,017,655 can be applied in some water dispensers. However, the design of the heat-exchangers in U.S. Pat. No. 7,017,655 still could not provide a effective heat exchange function to decrease power-consuming.

SUMMARY OF THE INVENTION

The invention is directed to a water dispenser, wherein the configuration of the assembly components and the setting of the heat-exchanger can upgrade the ability of energy-saving The heat-exchanger increases the contacting area between the fins and heat-exchange fluid substantially, and results in heat-exchange operation efficiently, thereby greatly enhance the temperature adjusting efficiency of water.

In the invention, a water dispenser is provided. The water dispenser is suited to adjust the temperature of water for drinking. The water dispenser comprises a first heat-exchanger, a heater, a first water-storage tank, a faucet, a first control valve, a second control valve, and a processor. The first heat-exchanger includes a first inlet, a first outlet, a second inlet, a second outlet, a first guiding-channel, and a second guiding-channel. The first inlet and the first outlet are communicated with two ends of the first guiding-channel respectively. The second inlet and the second outlet are communicated with two ends of the second guiding-channel respectively, wherein the water flows into the first heat-exchanger from the first inlet, and out of the first heat-exchanger from the first outlet through the first guiding-channel.

One end of the heater is connected to the first outlet, and another end of the heater is connected to the second inlet. The heater is suitable to heat the water flowed out of the first outlet. The heated water is suitable to flow into the first heat-exchanger from the second inlet, and flows out of the first heat-exchanger from the second outlet through second guiding-channel. One end of the first water-storage tank is connected to the second outlet for storing the water flowed out of the second outlet. The faucet is connected to another end of the first water-storage tank and another end of the heater respectively. The first control valve is disposed between the heater and the faucet, wherein when the temperature of water heated by the heater is in a first predetermined temperature range, the first control valve is opened to make the water flow out of the faucet. The second control valve is disposed between the first water-storage tank and the faucet, wherein when the temperature of water in the first water-storage tank is in a second predetermined temperature range, the second control valve is opened to make the water flow out of the faucet. The processor controls a open state or a closed state of the first control valve and the second control valve according to a instruction input by a user.

In one embodiment of the present invention, the water dispenser further includes a third control valve, the third control valve is disposed between the first water-storage tank and the second outlet for controlling the water flowed out of the second outlet to flow into the first water-storage tank, and the processor controls the operation of the third control valve. When the first control valve is opened, and the second and the third control valve is closed, the hot water can flows out of the faucet.

In one embodiment of the present invention, the first water-storage tank includes a first water amount detecting unit coupled to the processor for detecting the water amount in the first water-storage tank. When the water amount in the first water-storage tank is greater than a first predetermined water amount or less than a second predetermined water amount, the processor controls the third control valve correspondingly to control the water amount flowed into the first water-storage tank.

In one embodiment of the present invention, the water dispenser further includes a second water-storage tank. The second water-storage tank is disposed between the heater and the first control valve for storing the water heated by the heater.

In one embodiment of the present invention, the water dispenser further includes a fourth control valve. The fourth control valve is disposed between the heater and the first inlet for controlling the water to flow into at least one of the heater and the first heat-exchanger, and the processor controls the operation of the fourth control valve.

In one embodiment of the present invention, the water dispenser further includes a fifth control valve. The fifth control valve is disposed between the heater and the second water-storage tank for controlling the water heated by the heater to flow into at least one of the second water-storage tank and the second inlet, and the processor controls the operation of the fifth control valve.

In one embodiment of the present invention, the second water-storage tank includes a second water amount detecting unit coupled to the processor for detecting the water amount in the second water-storage tank. When the water amount in the second water-storage tank is greater than a third predetermined water amount or less than a fourth predetermined water amount, the processor controls the fifth control valve correspondingly to control the water amount flowed into the second water-storage tank.

In one embodiment of the present invention, the water dispenser further includes a second heat-exchanger and a cooler, the second heat-exchanger is disposed between the first water-storage tank and the second control valve, wherein the second heat-exchanger includes a third inlet, a third outlet, a fourth inlet, a fourth outlet, a third guiding-channel and a fourth guiding-channel, the third inlet and the third outlet are communicated with two ends of the third guiding-channel, the fourth inlet and the fourth outlet are communicated with two ends of the fourth guiding-channel, the water in the first water-storage tank flows into the second heat-exchanger from the third inlet, and flows out of the second heat-exchanger from the third outlet, and the fourth inlet is connected to one end of the cooler, the fourth outlet is connected to another end of the cooler.

In one embodiment of the present invention, the water dispenser further includes a water filter, a first pump, a second pump, and a third pump, the first pump is disposed between the first outlet and the heater for driving the water flowed out of the first outlet flow into the heater, the second pump is disposed between the first water-storage tank and the faucet for driving the water in the first water-storage tank flow to the faucet, the third pump is disposed between the second heat-exchanger and the cooler for driving a cooling fluid in the cooler flow to the second heat-exchanger, and the processor controls the operation of the first pump, the second pump, and the third pump, the water filter is used to filter the water, and the filtered water flows into the first heat-exchanger from the first inlet.

In one embodiment of the present invention, the first heat-exchanger includes at least a first fin and at least a second fin. Each first fin has a first body, a first communicating-groove structure, a second communicating-groove structure, and a first connecting-groove structure, the first communicating-groove structure, the second communicating-groove structure, and the first connecting-groove structure are disposed in the first body. Each second fin has a second body, a third communicating-groove structure, a fourth communicating-groove structure, and a second connecting-groove structure, the third communicating-groove structure, the fourth communicating-groove structure, and the second connecting-groove structure are disposed in the second body. Each first fin and each second fin are contacted along a assembly axis, the first communicating-groove structure and the second communicating-groove structure are communicated with the second connecting-groove structure, the third communicating-groove structure and the fourth communicating-groove structure are communicated with the first connecting-groove structure, and the first communicating-groove structure, the second connecting-groove structure, and the second communicating-groove structure constitute a first guiding-channel, the third communicating-groove structure, the first connecting-groove structure, and the fourth communicating-groove structure constitute a second guiding-channel.

In one embodiment of the present invention, the first fin and the second fin are rectangular sheets, the first communicating-groove structure and the second communicating-groove structure are disposed in two sides of the first body respectively, the third communicating-groove structure and the fourth communicating-groove structure are disposed in two sides of the second body respectively, and the projection area of the first communicating-groove structure of the first fin in the second body and the projection area of the second communicating-groove structure in the second body are not overlapped with the third communicating-groove structure and the fourth communicating-groove structure, the projection area of the first connecting-groove structure of the first fin in the second body is not overlapped with the second connecting-groove structure.

In one embodiment of the present invention, the projection area of the first communicating-groove structure in the second body and the projection area of the second communicating-groove structure in the second body are overlapped with the second connecting-groove structure respectively, the projection area of the third communicating-groove structure in the first body and the projection area of the fourth communicating-groove structure in the first body are overlapped with the first connecting-groove structure respectively.

In one embodiment of the present invention, the projection area of the first communicating-groove structure in the second body and the projection area of the second communicating-groove structure in the second body are overlapped with two ends of the second connecting-groove structure respectively, the projection area of the third communicating-groove structure and the fourth communicating-groove structure of the second fin in the first body is overlapped with two ends of the first connecting-groove structure respectively.

In one embodiment of the present invention, the projection area of two ends of the first connecting-groove structure in the second body is greater or equal to the area of the third communicating-groove structure and the fourth communicating-groove structure respectively. The projection area of two ends of the second connecting-groove structure in the first body is greater or equal to the area of the first communicating-groove structure and the second communicating-groove structure respectively.

In one embodiment of the present invention, each first fin and each second fin are staggered along the assembly axis, and the first connecting-groove structure and the second connecting-groove structure are disposed in the first body and the second body along a connecting axis respectively, wherein the connecting axis is vertical to the assembly axis.

In one embodiment of the present invention, the first guiding-channel is a 「 ⊔ 」 type guiding-channel. The second guiding-channel is a 「 ⊓ 」 type guiding-channel.

In one embodiment of the present invention, the guiding direction of the fluid in the first guiding-channel and the guiding direction of the fluid in the second guiding-channel are clockwise or counterclockwise simultaneously.

In one embodiment of the present invention, the second fin is the state of the rotating 180 degrees of the first fin along the assembly axis.

In one embodiment of the present invention, the second fin is an inverted state of the first fin.

In one embodiment of the present invention, the first heat-exchanger further includes a third fin and a fourth fin, the third fin and the fourth fin are disposed in two sides of the assembly of the first fin and the second fin along the assembly axis respectively, the third fin has a first through hole and a third through hole, the fourth fin has a second through hole and a fourth through hole, the first through hole and the third through hole are connected to two ends of the first guiding-channel, the first through hole is connected to the first inlet, the third through hole is connected to the first outlet, the second through hole and the fourth through hole are connected to two ends of the second guiding-channel, the second through hole is connected to the second inlet, the fourth through hole is connected to the second outlet, and the first through hole is communicated with the first communicating-groove structure, the third through hole is communicated with the second communicating-groove structure, the second through hole is communicated with the third communicating-groove structure, the fourth through hole is communicated with the fourth communicating-groove structure.

In one embodiment of the present invention, the projection area of the first through hole and the third through hole of the third fin in the fourth fin is not overlapped with the second through hole and the fourth through hole.

In one embodiment of the present invention, the fourth fin is an inverted state of the third fin.

In one embodiment of the present invention, the first heat-exchanger further includes at least a fifth fin, each fifth fin is disposed between the first fin and the second fin along the assembly axis, each fifth fin has a fifth through hole, a sixth through hole, a seventh through hole, and a eighth through hole. The fifth through hole and the sixth through hole are communicated with the first guiding-channel, and the seventh through hole and the eighth through hole are communicated with the second guiding-channel.

In one embodiment of the present invention, one side of the fifth through hole and the sixth through hole is communicated with the first communicating-groove structure and the second communicating-groove structure respectively, another side of the fifth through hole and the sixth through hole is communicated with two ends of the second connecting-groove structure respectively, one side of the seventh through hole and the eighth through hole is communicated with the third communicating-groove structure and the fourth communicating-groove structure respectively, another side of the seventh through hole and the eighth through hole is communicated with two ends of the first connecting-groove structure respectively.

In one embodiment of the present invention, the first connecting-groove structure and the second connecting-groove structure are wavy type structures or jagged type structures.

In one embodiment of the present invention, the first heat-exchanger includes at least a first fin and at least a second fin. Each first fin has a first body, a first communicating-groove structure, a second communicating-groove structure, and a first connecting-groove structure, the first communicating-groove structure, the second communicating-groove structure, and the first connecting-groove structure are disposed in the first body. The first connecting-groove structure has multiple first connecting-groove assemblies arranged in the first body along a disposing axis. Each second fin has a second body, a third communicating-groove structure, a fourth communicating-groove structure, and a second connecting-groove structure, the third communicating-groove structure, the fourth communicating-groove structure, and the second connecting-groove structure are disposed in the second body. The second connecting-groove structure has multiple second connecting-groove assemblies arranged in the second body along the disposing axis. Each first fin and each second fin are connected along a assembly axis, the second connecting-groove assemblies are communicated with the first communicating-groove structure and the second communicating-groove structure, the first connecting-groove assemblies are communicated with the third communicating-groove structure and the fourth communicating-groove structure, the first communicating-groove structure, the second connecting-groove structure, and the second communicating-groove structure constitute a first guiding-channel, the third communicating-groove structure, the first connecting-groove structure, and the fourth communicating-groove structure constitute a second guiding-channel.

In one embodiment of the present invention, one end of each second connecting-groove assembly of the second fin is overlapped with the first communicating-groove structure of the adjacent first fin in a connecting axis, the other end of each second connecting-groove assembly is overlapped with the second communicating-groove structure of the first fin, one end of each first connecting-groove assembly of the first fin is overlapped with the third communicating-groove structure of the adjacent second fin along the connecting axis, the other end of each first connecting-groove assembly is overlapped with the fourth communicating-groove structure of the second fin.

In one embodiment of the present invention, the assembly axis, the disposing axis, and the connecting axis are vertical to each other.

In one embodiment of the present invention, the first communicating-groove structure has multiple first communicating-groove assemblies arranged in the first body along the disposing axis, the third communicating-groove structure has multiple third communicating-groove assemblies arranged in the second body along the disposing axis, one end of each second connecting-groove assembly of the second fin is overlapped with the first communicating-groove assembly of the adjacent first fin along the connecting axis, the other end of each second connecting-groove assembly is overlapped with the second communicating-groove structure along the connecting axis, one end of each first connecting-groove assembly of the first fin is overlapped with the third communicating-groove assembly of the adjacent second fin along the connecting axis, the other end of each first connecting-groove assembly is overlapped with the fourth communicating-groove structure along the connecting axis, the first communicating-groove assemblies and the first connecting-groove assemblies arranged in the first body are staggered along the disposing axis, the third communicating-groove assemblies and the second connecting-groove assemblies arranged in the second body are staggered along the disposing axis.

In one embodiment of the present invention, the first communicating-groove assemblies and the first connecting-groove assemblies arranged in the first body are staggered along the disposing axis, and the third communicating-groove assemblies and the second connecting-groove assemblies arranged in the second body are staggered along the disposing axis.

In one embodiment of the present invention, each first communicating-groove assembly has at least a first communicating-groove unit arranged in the first body along the connecting axis, each first connecting-groove assembly has at least a first connecting-groove unit arranged in the first body along the connecting axis, each third communicating-groove assembly has at least a third communicating-groove unit arranged in the second body along the connecting axis, each second connecting-groove assembly has at least a second connecting-groove unit arranged in the second body along the connecting axis, one end of the second connecting-groove unit of the second fin is overlapped with one end of the first communicating-groove unit of the adjacent first fin, the other end of the second connecting-groove unit is overlapped with one end of another first communicating-groove unit of the first fin or the second communicating-groove structure of the first fin, one end of the first connecting-groove unit of the first fin is overlapped with one end of the third communicating-groove unit of the adjacent second fin, the other end of the first connecting-groove unit is overlapped with one end of another third communicating-groove unit of the second fin or the fourth communicating-groove structure of the second fin.

In one embodiment of the present invention, the two first communicating-groove units overlapped with the second connecting-groove unit are arranged in the first body along the connecting axis closely, and the two third communicating-groove units overlapped with the first connecting-groove unit are arranged in the second body along the connecting axis closely.

In one embodiment of the present invention, the projection area of the first communicating-groove structure of the first fin in the second body and the projection area of the second communicating-groove structure in the second body are not overlapped with the third communicating-groove structure and the fourth communicating-groove structure, the projection area of the first connecting-groove structure of the first fin in the second body is not overlapped with the second connecting-groove structure.

In one embodiment of the present invention, each first fin and each second fin are staggered along the assembly axis.

In one embodiment of the present invention, the first guiding-channel is a 「 ⊔ 」 type guiding-channel. The second guiding-channel is a 「 ⊓ 」 type guiding-channel. The guiding direction of the fluid in the first guiding-channel and the guiding direction of the fluid in the second guiding-channel are clockwise or counterclockwise simultaneously.

In one embodiment of the present invention, the second fin is the state of the rotating 180 degrees of the first fin along the assembly axis or the inverted state of the first fin.

In one embodiment of the present invention, the first heat-exchanger further includes a third fin and a fourth fin, the third fin and the fourth fin are disposed in two sides of the assembly of the first fin and the second fin along the assembly axis respectively, the third fin has a first through hole and a third through hole, the fourth fin has a second through hole and a fourth through hole, the first through hole and the third through hole are connected to two ends of the first guiding-channel, the first through hole is connected to the first inlet, the third through hole is connected to the first outlet, the second through hole and the fourth through hole are connected to two ends of the second guiding-channel, the second through hole is connected to the second inlet, the fourth through hole is connected to the second outlet, and the first through hole is communicated with the first communicating-groove structure, the third through hole is communicated with the second communicating-groove structure, the second through hole is communicated with the third communicating-groove structure, the fourth through hole is communicated with the fourth communicating-groove structure.

In one embodiment of the present invention, the projection area of the first through hole and the third through hole of the third fin in the fourth fin is not overlapped with the second through hole and the fourth through hole, and the fourth fin is an inverted state of the third fin.

In one embodiment of the present invention, the first through hole has multiple first through hole units arranged along the disposing axis, and the second through hole has multiple second through hole units arranged along the disposing axis. The first through hole units are communicated with the first communicating-groove structure, and the second through hole units are communicated with the third communicating-groove structure.

In one embodiment of the present invention, the projection area of the first through hole units in the first body is overlapped with the first communicating-groove structure, and the projection area of the second through hole units in the second body is overlapped with the third communicating-groove structure.

In one embodiment of the present invention, the first heat-exchanger further includes a fifth fin and a sixth fin, the fifth fin and the sixth fin are disposed in two sides of the assembly of each first fin, each second fin, each third fin, and each fourth fin along the assembly axis respectively, the fifth fin has a fifth through hole and a sixth through hole, the sixth fin has a seventh through hole and a eighth through hole, one side of the first through hole is communicated with the first communicating-groove structure, another side of the first through hole is communicated with the fifth through hole, one side of the third through hole is communicated with the second communicating-groove structure, another side of the third through hole is communicated with the sixth through hole, one side of the second through hole is communicated with the third communicating-groove structure, another side of the second through hole is communicated with the seventh through hole, one side of the fourth through hole is communicated with the fourth communicating-groove structure, another side of the fourth through hole is communicated with the eighth through hole, the sixth fin is the inverted state of the fifth fin.

In one embodiment of the present invention, the first heat-exchanger includes at least a first fin and at least a second fin. Each first fin has a first body, a first communicating-groove structure, a second communicating-groove structure, and a first connecting-groove structure, the first communicating-groove structure, the second communicating-groove structure, and the first connecting-groove structure are disposed in the first body. The first communicating-groove structure has multiple first communicating-groove assemblies arranged in the first body along a disposing axis, the first connecting-groove structure has multiple first connecting-groove assemblies arranged in the first body along the disposing axis, each first communicating-groove assembly has multiple first communicating-groove units arranged in the first body along a connecting axis, each first connecting-groove assembly has multiple first connecting-groove units arranged in the first body along the connecting axis. Each second fin has a second body, a third communicating-groove structure, a fourth communicating-groove structure, and a second connecting-groove structure, the third communicating-groove structure, the fourth communicating-groove structure, and the second connecting-groove structure are disposed in the second body. The third communicating-groove structure has multiple third communicating-groove assemblies arranged in the second body along the disposing axis, the second connecting-groove structure has multiple second connecting-groove assemblies arranged in the second body along the disposing axis, each third communicating-groove assembly has multiple third communicating-groove units arranged in the second body along the connecting axis, each second connecting-groove assembly has multiple second connecting-groove units arranged in the second body along the connecting axis. Each first fin and each second fin are connected along a assembly axis, the second connecting-groove assemblies are communicated with the first communicating-groove structure and the second communicating-groove structure, the first connecting-groove assemblies are communicated with the third communicating-groove structure and the fourth communicating-groove structure, the first communicating-groove unit of each first communicating-groove assembly is staggered with the adjacent first communicating-groove unit, the first connecting-groove unit of each first connecting-groove assembly is staggered with the adjacent first connecting-groove unit, the third communicating-groove unit of each third communicating-groove assembly is staggered with the adjacent third communicating-groove unit, the second connecting-groove unit of each second connecting-groove assembly is staggered with the adjacent second connecting-groove unit, and the first communicating-groove structure, the second connecting-groove structure, and the second communicating-groove structure constitute a first guiding-channel, the third communicating-groove structure, the first connecting-groove structure, and the fourth communicating-groove structure constitute a second guiding-channel.

In one embodiment of the present invention, one end of each second connecting-groove assembly of the second fin is overlapped with the first communicating-groove structure of the adjacent first fin along the connecting axis, the other end of each second connecting-groove assembly is overlapped with the second communicating-groove structure of the first fin, one end of each first connecting-groove assembly of the first fin is overlapped with the third communicating-groove structure of the adjacent second fin along the connecting axis, the other end of each first connecting-groove assembly is overlapped with the fourth communicating-groove structure of the second fin.

In one embodiment of the present invention, one end of the second connecting-groove unit of the second fin is overlapped with one end of the first communicating-groove unit of the adjacent first fin, the other end of the second connecting-groove unit is overlapped with one end of another first communicating-groove unit of the first fin or the second communicating-groove structure of the first fin, one end of the first connecting-groove unit of the first fin is overlapped with one end of the third communicating-groove unit of the adjacent second fin, the other end of the first connecting-groove unit is overlapped with one end of another third communicating-groove unit of the second fin or the fourth communicating-groove structure of the second fin.

In one embodiment of the present invention, the two first communicating-groove units overlapped with the second connecting-groove unit are arranged in the first body along the connecting axis closely, and the two third communicating-groove units overlapped with the first connecting-groove unit are arranged in the second body along the connecting axis closely.

In one embodiment of the present invention, the second connecting-groove unit of the second fin is communicated with the two adjacent first communicating-groove units arranged along the disposing axis and the two adjacent first communicating-groove units arranged along the connecting axis in the first fin. The first connecting-groove unit of the first fin is communicated with the two adjacent third communicating-groove units arranged along the disposing axis and the two adjacent third communicating-groove units arranged along the connecting axis in the second fin.

In one embodiment of the present invention, the first communicating-groove unit, the third communicating-groove unit, the first connecting-groove unit, and the second connecting-groove unit are diamond type structures.

In one embodiment of the present invention, the second communicating-groove structure has multiple second communicating-groove units arranged in the first body along the disposing axis, each second communicating-groove unit is arranged in one side of the corresponding first communicating-groove assembly along the connecting axis, the fourth communicating-groove structure has multiple fourth communicating-groove units arranged in the second body along the disposing axis, each fourth communicating-groove unit is arranged in one side of the corresponding third communicating-groove assembly along the connecting axis.

the second communicating-groove structure has multiple second communicating-groove units arranged in the first body along the disposing axis, each second communicating-groove unit is arranged in one side of the corresponding first communicating-groove assembly along the connecting axis, the fourth communicating-groove structure has multiple fourth communicating-groove units arranged in the second body along the disposing axis, each fourth communicating-groove unit is arranged in one side of the corresponding third communicating-groove assembly along the connecting axis.

In one embodiment of the present invention, the first communicating-groove structure further includes a first mainstream channel, each first communicating-groove assembly constitutes to a tributary channel connected with the first mainstream channel along the connecting axis, the first connecting-groove structure further includes a second mainstream channel, each first connecting-groove assembly constitutes to another tributary channel connected with the second mainstream channel along the connecting axis, the third communicating-groove structure further includes a third mainstream channel, each third communicating-groove assembly constitutes to another tributary channel connected with the third mainstream channel along the connecting axis, the second connecting-groove structure further includes a fourth mainstream channel, each second connecting-groove assembly is connected with the fourth mainstream channel along the connecting axis, the first mainstream channel and the fourth mainstream channel are communicated with each other, the third mainstream channel and the second mainstream channel are communicated with each other.

In one embodiment of the present invention, the projection area of the second connecting-groove structure in the first body is overlapped with the first communicating-groove structure and the second communicating-groove structure, and the projection area of the first connecting-groove structure in the second body is overlapped with the third communicating-groove structure and the fourth communicating-groove structure.

In one embodiment of the present invention, the first communicating-groove structure, the first connecting-groove structure, the third communicating-groove structure, and the second connecting-groove structure are similar to the "claw" type structure or the "E" type structure.

In one embodiment of the present invention, the first communicating-groove structure and the first connecting-groove structure are embedded in the first body, the third communicating-groove structure and the second connecting-groove structure are embedded in the first body, the second communicating-groove structure is disposed between the second mainstream channel and the first communicating-groove structure, the fourth communicating-groove structure is disposed between the fourth mainstream channel and the third communicating-groove structure.

In one embodiment of the present invention, the first heat-exchanger further includes a third fin and a fourth fin, the third fin and the fourth fin are disposed in two sides of the assembly of the first fin and the second fin along the assembly axis respectively, the third fin has a first through hole and a third through hole, the fourth fin has a second through hole and a fourth through hole, the first through hole and the third through hole are connected to two ends of the first guiding-channel, the first through hole is connected to the first inlet, the third through hole is connected to the first outlet, the second through hole and the fourth through hole are connected to two ends of the second guiding-channel, the second through hole is connected to the second inlet, the fourth through hole is connected to the second outlet, and the first through hole is communicated with the first communicating-groove structure, the third through hole is communicated with the second communicating-groove structure, the second through hole is communicated with the third communicating-groove structure, the fourth through hole is communicated with the fourth communicating-groove structure.

In one embodiment of the present invention, the projection area of the first through hole and the third through hole of the third fin in the fourth fin is not overlapped with the second through hole and the fourth through hole.

In one embodiment of the present invention, the third through hole has multiple third through hole units arranged along the disposing axis, the fourth through hole has multiple fourth through hole units arranged along the disposing axis. The third through hole units are communicated with the second communicating-groove structure, and the fourth through hole units are communicated with the fourth communicating-groove structure.

In one embodiment of the present invention, the projection area of the third through hole units in the first body are overlapped with the second communicating-groove structure, and the projection area of the fourth through hole units in the second body are overlapped with the fourth communicating-groove structure In one embodiment of the present invention, the first heat-exchanger further includes a fifth fin and a sixth fin, the fifth fin and the sixth fin are disposed in two sides of the assembly of each first fin, each second fin, each third fin, and each fourth fin along the assembly axis respectively, the fifth fin has a fifth through hole and a sixth through hole, the sixth fin has a seventh through hole and a eighth through hole, one side of the first through hole is communicated with the first communicating-groove structure, and another side of the first through hole is communicated with the fifth through hole, one side of the third through hole is communicated with the second communicating-groove structure, and another side of the third through hole is communicated with the sixth through hole, one side of the second through hole is communicated with the third communicating-groove structure, and another side of the second through hole is communicated with the seventh through hole, one side of the fourth through hole is communicated with the fourth communicating-groove structure, and another side of the fourth through hole is communicated with the eighth through hole, and the second fin is an inverted state of the first fin, the fourth fin is an inverted state of the third fin, the sixth fin is the inverted state of the fifth fin.

As described in the embodiments of the invention, in the invention of the water dispenser, the water in the water dispenser can keep in a predetermined temperature by the configuration of the assembly components of the water dispenser, the additional hot water, and a heat-exchanger having a good heat-exchange efficiency. Therefore, when the user want to drink the hot water, the warm water, or the cold water, the demand water will be provided by the water dispenser effectively and quickly, while both energy-saving efficiency.

In detail, the demand amount of hot water may be less than the predetermined amount provided by the water dispenser in the process of drinking hot water, and the invention applies the additional hot water to heat exchange with the water at normal temperature. Thus, users can get warm water quickly. The above heat exchange practice can save energy substantially, and has no demand to heat the water at normal temperature for getting warm water frequently. Furthermore, due to the above additional hot water can execute the heat exchange practice with the water at normal temperature efficiently to make the drinking water keep in a predetermined temperature, and achieve the purpose to save energy. On the other hand, the invention has a good heat-exchange efficiency.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Other features and advantages of the invention will be further understood from the further technological features disclosed by the embodiments of the invention wherein there are shown and described embodiments of this invention, simply by way of illustration of best modes to carry out the invention.

Figure 1A:
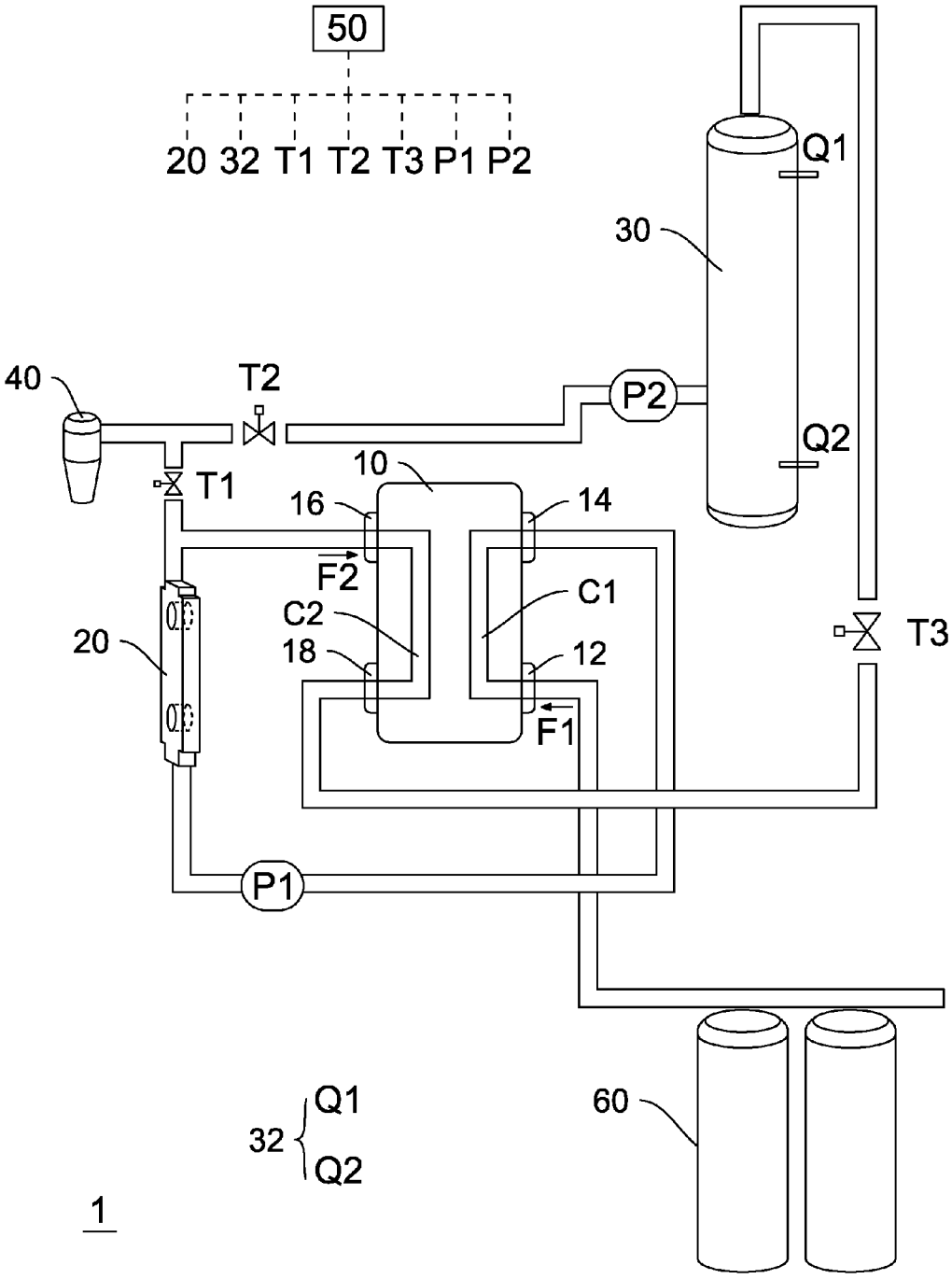
FIG. 1A is a schematic view illustrating the water dispenser according to one embodiment of the present invention.

FIG. 1A is a schematic view illustrating the water dispenser according to one embodiment of the present invention. Referring to FIG. 1A, the water dispenser 1 of the present embodiment is suited to adjust the temperature of water for drinking. The water dispenser 1 includes a first heat-exchanger 10, a heater 20, a first water-storage tank 30, a faucet 40, a first control valve T1, a second control valve T2, and a processor 50 mainly. In addition, the water dispenser 1 of the present embodiment further includes a third control valve T3, a water filter 60, a first pump P1, and a second pump P2. The processor 50 controls a open state or a closed state of the heater 20, the first control valve T1, and the second control valve T2 according to a instruction input by a user. The processor 50 also controls the open state or the closed state of the first pump P1 and the second pump P2. In the present embodiment, the first heat-exchanger 10 has a first inlet 12, a first outlet 14, a second inlet 16, a second outlet 18, a first guiding-channel C1, and a second guiding-channel C2. The first inlet 12 and the first outlet 14 are communicated with two ends of the first guiding-channel C1 respectively. The second inlet 16 and the second outlet 18 are communicated with two ends of the second guiding-channel C2 respectively. In the present embodiment, the water flows into the first heat-exchanger 10 from the first inlet 12, and flows out of the first heat-exchanger 10 from the first outlet 14 through the first guiding-channel C1.

In the present embodiment, one end of the heater 20 is connected to the first outlet 14, and another end of the heater 20 is connected to the second inlet 16. The heater 20 is suited to heat the water flowed out of the first outlet 14, the heated water flows into the first heat-exchanger 10 again from the second inlet 16, and flows out of the first heat-exchanger 10 again from the second outlet 18 through the second guiding-channel C2. In addition, one end of the first water-storage tank 30 is connected to the second outlet 18, and the first water-storage tank 30 is used to store the water flowed out of the second outlet 18. The faucet 40 is connected to another end of the first water-storage tank 30 and another end of the heater 20 respectively. In addition, the first control valve T1 is disposed between the heater 20 and the faucet 40, the second control valve T2 is disposed between the first water-storage tank 30 and the faucet 40, and the third control valve T3 is disposed between the first water-storage tank 30 and the second outlet 18. The water filter 60 is used to filter and clean the water flowed into the water dispenser 1, and the filtered water flows into the first heat-exchanger 10 from the first inlet 12.

From the above, when the user wants to drink hot water, the processor 50 will start the first pump P1 disposed between the first outlet 14 and the heater 20. The first pump P1 will drive the water filtered by the water filter 60 to flow into the heater 20 through the first heat-exchanger 10, and the heater 20 will heat the water to raise to be in a first predetermined temperature range. The first predetermined temperature range is, for example, between 98~100° C. The processor 50 will open the first control valve T1 to make the water flow out of the faucet 40 for drinking. In the present embodiment, when the water dispenser 1 executes a first cycle, the first pump P1 will drive 200~250 cc of water amount per minute. When the water dispenser 1 executes a second cycle, the first pump P1 will drive 900~1000 cc of water amount per minute. The heater 20 of the present embodiment provides the power about 1300 W, for example, and make the water amount about 250 cc at normal temperature to raise to 98° C. per minute. In addition, when the user wants to drink hot water, the first pump P1 will delay 5 seconds to start. Thus, the heater 20 can execute a pre-heating practice after starting by the processor 50.

In the heat exchange practice of the first heat-exchanger 10, the temperature of water heated by the heater 20 early still not to reach 100° C., and just reach 98° C. for example. The water will flow into the first heat-exchanger 10 from the second inlet 16. On the other hand, the water filtered by the water filter 60 will flow into the first heat-exchanger 10 from the first inlet 12 to execute the heat exchange practice. The water with higher temperature flowed into the first heat-exchanger 10 from the second inlet 16 will flow out of the first heat-exchanger 10 through the second guiding-channel C2 after executing the heat exchange practice, and the water temperature may lower to be normal temperature. The water at normal temperature flowed into the first heat-exchanger 10 from the first inlet 12 will flow out of the first heat-exchanger 10 from the first outlet 14 through the first guiding-channel C1 after executing the heat exchange practice, and the water temperature may raise to 88° C. substantially. The water raised substantially will be drive to the heater 20 by the first pump P1, and the water will raise to 100° C. for drinking quickly.

In a state that the demand amount of the hot water is less than the predetermined water amount provided by water dispenser 1 in this cycle, because the additional water with higher temperature has been heated to 100° C. by the heater 20, so that when the heat water flows into the first heat-exchanger 10 from the second inlet 16, and flows out of the first heat-exchanger 10 from the second outlet 18 to execute the heat exchange practice again, the temperature of the flowed water this time will be higher than the temperature of the flowed water in last cycle. The water temperature will raise to 40~50° C. from normal temperature gradually, and become to be a warm water. Next, the warm water will be driven to store in the first water-storage tank 30. Definitely, the processor 50 will open the third control valve T3 to make the warm water flowed out of the second outlet 18 flow into the first water-storage tank 30 smoothly. Then, a water storage practice is finished. Worth mentioning is that when the temperature of water in the first water-storage tank 30 is lowered to be normal temperature gradually, other embodiments can make the addition water with higher temperature flow into the first water-storage tank 30 in the open state of the third control valve T3, and keep the temperature of water in the first water-storage tank 30 in a warm water state about 40~50° C. The above operation must be on the premise that the demand amount of the hot water is less than the predetermined water amount provided by water dispenser and the external water is no longer into the water dispenser 1.

The above first water-storage tank 30 can includes a first water amount detecting unit 32 coupled to the processor 50. The first water amount detecting unit 32 is used to detect the water amount in the first water-storage tank 30. When the water amount in the first water-storage tank 30 is greater than a first predetermined water amount Q1 or less than a second predetermined water amount Q2, the processor 50 will controls the third control valve T3 correspondingly to control the water amount flowed into the first water-storage tank 30.

On the other hand, when the user wants to drink warm water and the temperature of water in the first water-storage tank 30 is in a second predetermined temperature range, the processor 50 will control the second control valve T2 to open, and make the water flow out of faucet 40 for drinking, wherein the second predetermined temperature range is about 40~50° C. In other embodiments, the second predetermined temperature range also can be other temperature suited to drink, and the present invention does not have any limitation. In addition, the present invention also can get the water with the demand of temperature from the first outlet 14 or the second outlet 18 by adjusting the temperature of water flowed into the first heat-exchanger 10 after the heat exchange practice. The second pump P2 is disposed between the first water-storage tank 30 and the faucet 40 in the present embodiment, and the processor 50 can control the operation of the second pump P2, wherein the second pump P2 can drive the water inside of the first water-storage tank 30 to flow to the faucet 40 for drinking.

Worth mentioning is that when the demand amount of the hot water is less than the predetermined water amount provided by water dispenser, the present invention can use the addition hot water to heat exchange with the water at normal temperature to get the warm water quickly in the above drinking of hot water. The above practice of the heat exchange between the addition hot water and the water at normal temperature can save energy substantially, and without executing the heating practice for providing the warm water frequently, wherein the frequent heating practice will consume energy.

Above description is for the water dispenser 1 provided two kinds water temperature state (hot water and warm water). Next, another water dispenser provided three kinds water temperature state (hot water, warm water, and cold water) of the invention will be illustrated.

Figure 1B:
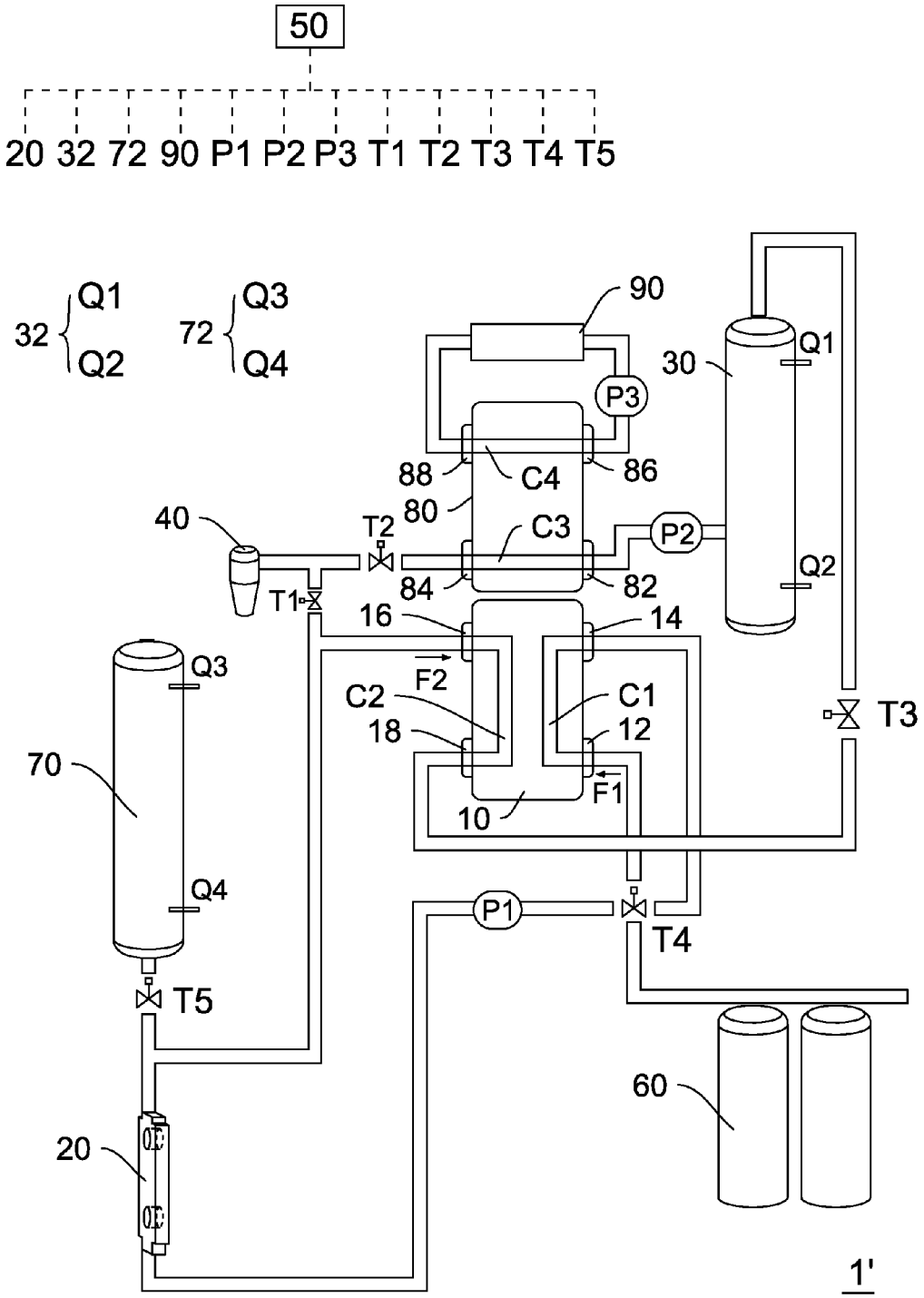
FIG. 1B is a schematic view illustrating the water dispenser according to another embodiment of the present invention.

FIG. 1B is a schematic view illustrating the water dispenser according to another embodiment of the present invention. Referring to FIG. 1B, the water dispenser 1' of the present embodiment is similar to the water dispenser 1 of the above embodiment, the difference between the water dispenser 1 and the water dispenser 1' is that: the water dispenser 1' of the present embodiment further has the ability of cold water providing. In detail, the water dispenser 1' of the present embodiment further includes a second water-storage tank 70, a fourth control valve T4, a fifth control valve T5, a third pump P3, a second heat-exchanger 80, and a cooler 90. The second water-storage tank 70 is disposed between the heater 20 and the first control valve T1, and used to store the water heated by the heater 20. The fourth control valve T4 is disposed between the inlet of the heater 20 and the first inlet 12, and controls the water to flow into at least one of the heater 20 and the first heat-exchanger 10, wherein the processor 50 can control the operation of the fourth control valve T4. The fifth control valve T5 is disposed between the heater 20 and the second water-storage tank 70, and controls the water heated by the heater 20 to flow into at least one of the second water-storage tank 70 and second inlet 16, wherein the processor 50 can control the operation of the fifth control valve T5.

As a result, the processor 50 can drive the fourth control valve T4 to open the channel, and make the water flow toward the heater 20 directly. At the same time, the processor 50 also can open the fifth control valve T5, and the water can flow to the second water-storage tank 70 for storing after being heated by the heater 20. The temperature of water in the second water-storage tank 70 is about 90~100° C., and the water amount of storage is about 200~600 cc, for example. Definitely, the present invention does not have any limitation. The second water-storage tank 70 has a second water amount detecting unit 72 coupled to the processor 50, for example. The second water amount detecting unit 72 is used to detect the water amount in the second water-storage tank 70. When the water amount in the second water-storage tank 70 is greater than a third predetermined water amount Q3 or less than a fourth predetermined water amount Q4, the processor 50 will controls the fifth control valve T5 correspondingly to control the water amount flowed into the second water-storage tank 70. In the present embodiment, when the user wants to drink hot water, the processor 50 will open the first control valve T1, and make the water with higher temperature in the second water-storage tank 70 flow out of the faucet 40 for drinking.

In addition, when the storage practice at the second water-storage tank 70 is finished, the processor 50 will drive the fourth control valve T4 to open the channel, and make the water flow to the first inlet 12. That is, the fourth control valve T4 can control the water to flow toward the first heat-exchanger 10 directly, and flow out of the first heat-exchanger 10 from the first heat-exchanger 10, further be driven toward the heater 20 by the first pump P1. At the same time, the processor 50 will close the fifth control valve T5, and the water heated by the heater 20 will be transform to the second inlet 16 of the first heat-exchanger 10 to execute the heat exchange practice. The same as the above embodiment, the hot water with higher temperature will flow into the first heat-exchanger 10 from the second inlet 16 to execute the heat exchange practice through the second guiding-channel C2, and flow out of the first heat-exchanger 10 from the second outlet 18, wherein the temperature of water will be lowered to be normal temperature. The water at normal temperature flowed into the first heat-exchanger 10 from the first inlet 12 will flow out of the first heat-exchanger 10 from the first outlet 14 through the first guiding-channel C1, and flow toward the first water-storage tank 30 to execute the warm water storage practice. Because the practicing mode and the effectiveness of the heat exchange practice and the warm water storage practice are the same as the above embodiment, and the details will not be described herein again.

Especially, the present embodiment has the ability of cold water providing, and the second heat-exchanger 80 is disposed between the first water-storage tank 30 and the second control valve T2. The second heat-exchanger 80 has a third inlet 82, a third outlet 84, a fourth inlet 88, a fourth outlet 86, a third guiding-channel C3, and a fourth guiding-channel C4, the third inlet 82 and the third outlet 84 are communicated with two ends of the third guiding-channel C3, and the fourth inlet 88 and the fourth outlet 86 are communicated with two ends of the fourth guiding-channel C4. The water in the first water-storage tank 30 flows into the second heat-exchanger 80 from the third inlet 82, and flows out of the second heat-exchanger 80 from the third outlet 84. In addition, in the present embodiment, the fourth inlet 88 is connected to one end of cooler 90, and the fourth outlet 86 is connected to another end of the cooler 90. The cooler 90 is coupled to the processor 50, for example. Furthermore, the third pump P3 is disposed between the second heat-exchanger 80 and the cooler 90 in the present embodiment, for example. The third pump P3 can drive the cooling fluid inside of the cooler 90 flow to the second heat-exchanger 80, and the processor 50 can control the operation of the third pump P3.

Therefore, when the user wants to drink cold water, the processor 50 will start the third pump P3 and the cooler 90, a cooling fluid in the cooler 90 will flow into the second heat-exchanger 80 from the fourth inlet 88, and execute the heat exchange practice through the fourth guiding-channel C4. Then, the cooling fluid will flow out of the second heat-exchanger 80 from the fourth outlet 86, and return to the cooler 90 for next cycle. On the other hand, the warm water stored in the first water-storage tank 30 will flow into the second heat-exchanger 80 from the third inlet 82 to execute the heat exchange practice through the third guiding-channel C3, and flows out of the second heat-exchanger 80 from the third outlet 84. Through the heat exchange practice, the warm water stored in the first water-storage tank 30 originally will be lowered substantially to become cold water. When the processor 50 open the second control valve T2, the cold water will flows out of the faucet 40 for drinking.

In the present embodiment, when the user wants to drink warm water, the processor 50 will not start the third pump P3 and the cooler 90, and the warm water stored in the first water-storage tank 30 will flow into the second heat-exchanger 80 from the third inlet 82 directly, and flow out of the second heat-exchanger 80 from the third outlet 84 through the third guiding-channel C3 without any heat exchange practice. The warm water flowed out of the second heat-exchanger 80 will flow out of the faucet 40 for drinking when the processor 50 opens the second control valve T2.

Above description is for the main components and the connection between the various components of the water dispenser 1 and the water dispenser 1'. In addition, the above description further includes that how the combination of the components to adjust the water temperature demand. Next, the design of the heat-exchanger in the water dispenser 1 and the water dispenser 1' of the invention will be illustrated, and the description of how to own a good heat-exchange efficiency. In order to illustrate conveniently, the following description takes the first heat-exchanger 10 as an example.

Figure 2A:
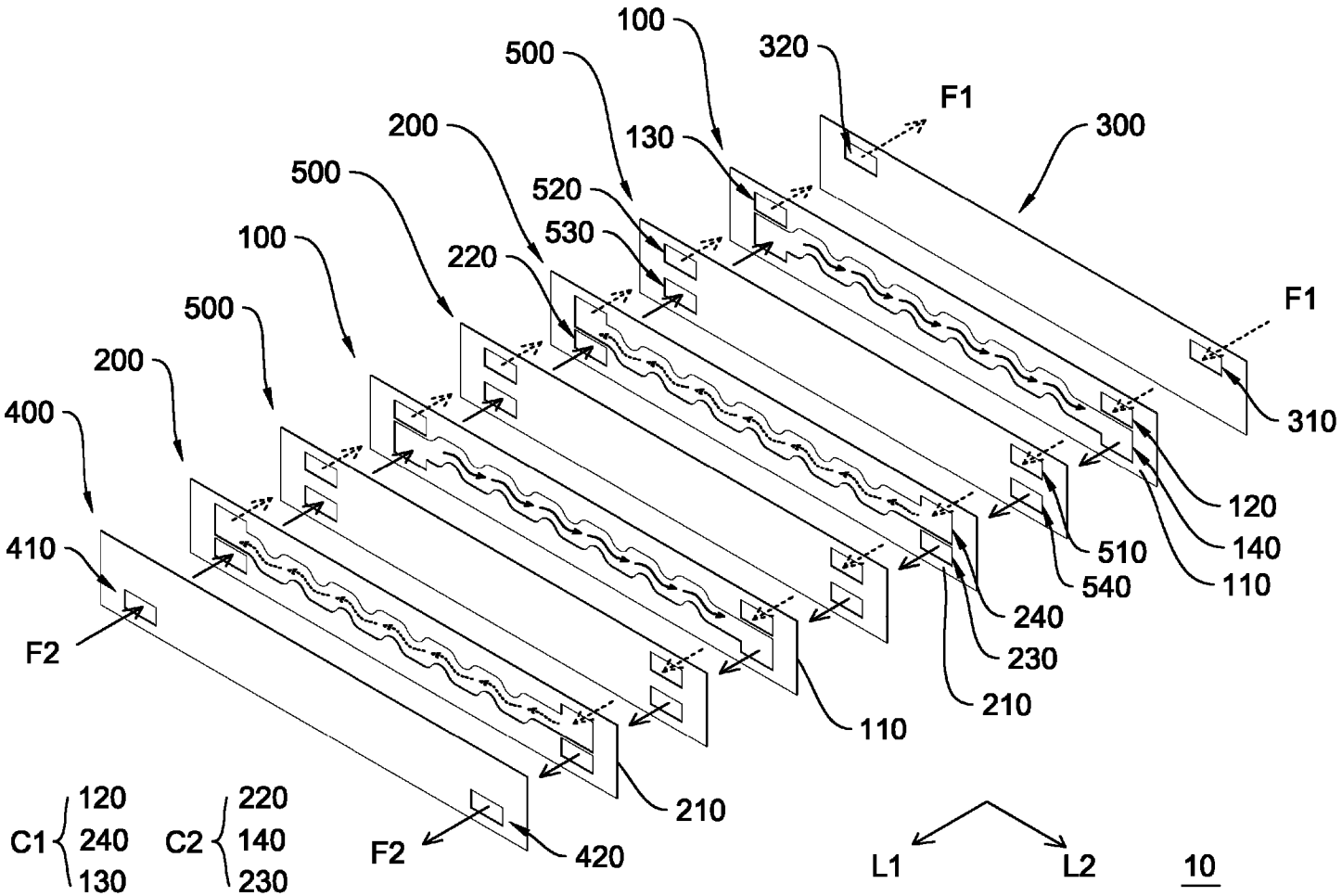
FIG. 2A is an exploded view illustrating the first heat-exchanger according to one embodiment of the present invention.
Figure 2B:
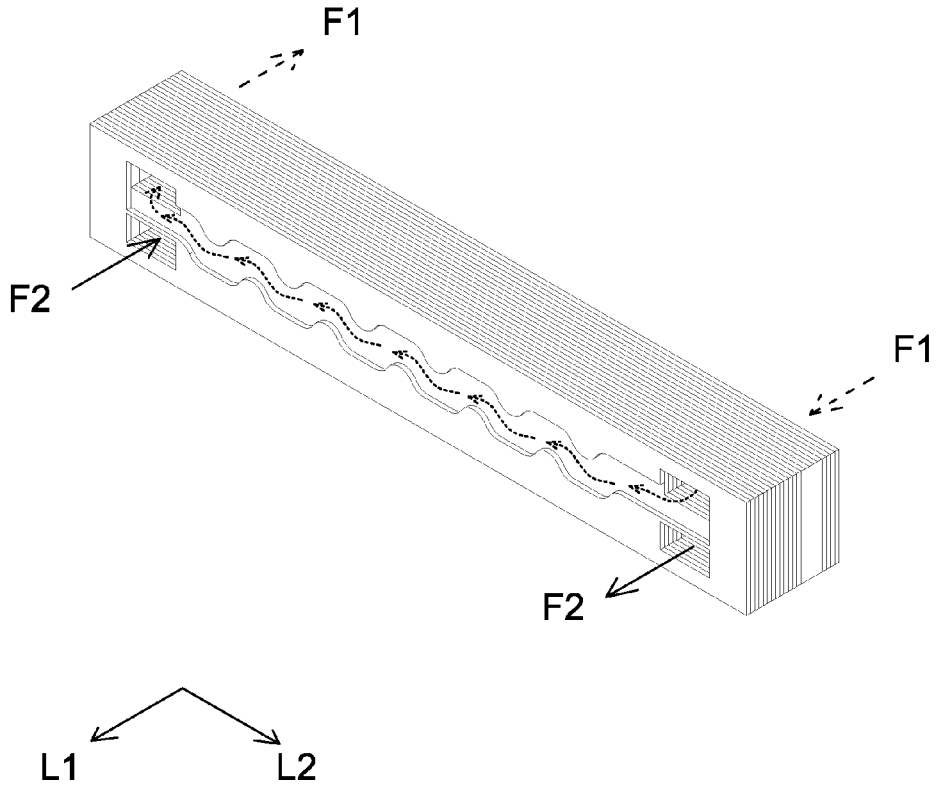
FIG. 2B is a schematic view illustrating the first heat-exchanger removing of partial of fins depicted in FIG. 2A.

FIG. 2A is an exploded view illustrating the first heat-exchanger according to one embodiment of the present invention, and FIG. 2B is a schematic view illustrating the first heat-exchanger removing of partial of fins depicted in FIG. 2A. Referring to FIG. 2A and FIG. 2B, the first heat-exchanger 10 in FIG. 2A includes a first fin 100, a second fin 200, a third fin 300, a fourth fin 400, and a fifth fin 500. The first fin 100, the second fin 200, the third fin 300, the fourth fin 400, and the fifth fin 500 are, for example, rectangular sheets, and are contacted along an assembly axis L1. The third fin 300 and the fourth fin 400 are, for example, disposed in two sides of the assembly of the first fin 100 and the second fin 200 along the assembly axis L1 respectively. Each fifth fin 500 is, for example, disposed between the first fin 100 and the second fin 200 along the assembly axis L1. In the present embodiment, the second fin 200 is, for example, an inverted state of the first fin 100. The inverted state is, for example, the state of the rotating 180 degrees of the first fin 100 along the assembly axis L1. The second fin 200 also be other inverted state of the first fin 100, including but not limited to this type. In addition, the fourth fin 400 also is, for example, the inverted state of the third fin 300.

The first heat-exchanger 10 of the present embodiment is constituted of at least a first fin 100 and at least a second fin 200 mainly, and the first fin 100 and the second fin 200 will be illustrated in detail as follow. The first fin 100 has a first body 110, a first communicating-groove structure 120, a second communicating-groove structure 130, and a first connecting-groove structure 140. The first communicating-groove structure 120, the second communicating-groove structure 130, and the first connecting-groove structure 140 are disposed in first body 110, and the first communicating-groove structure 120 and the second communicating-groove structure 130 are disposed in two sides of first body 110 respectively. The first connecting-groove structure 140 is disposed in the first body 110 along a connecting axis L2. The connecting axis L2 is, for example, vertical to the assembly axis L1.

In addition, the second fin 200 has a second body 210, a third communicating-groove structure 220, a fourth communicating-groove structure 230, and a second connecting-groove structure 240, and the third communicating-groove structure 220, the fourth communicating-groove structure 230, and the second connecting-groove structure 240 are disposed in the second body 210. The third communicating-groove structure 220 and the fourth communicating-groove structure 230 are disposed in two sides of the second body 210 respectively, and the second connecting-groove structure 240 is disposed in the second body 210 along the connecting axis L2. The first connecting-groove structure 140 and the second connecting-groove structure 240 of the present embodiment are, for example, wavy type structures. The heat-exchange fluid flowed into the first heat-exchanger 10 will be collided to have a turbulence constantly by the wavy type structures of the first connecting-groove structure 140 and the second connecting-groove structure 240. This upgrades the heat-exchange efficiency of the fins. The first connecting-groove structure and the second connecting-groove structure in other embodiments are, for example, jagged type structures or appropriate structures capable of increasing the turbulence of the heat-exchange fluid, and the present invention does not have any limitation.

From the above, when the first fin 100, the second fin 200, the third fin 300, the fourth fin 400, and the fifth fin 500 are contacted with each other along the assembly axis L1, the second connecting-groove structure 240 is communicated with the first communicating-groove structure 120 and the second communicating-groove structure 130, and the first connecting-groove structure 140 is communicated with the third communicating-groove structure 220 and the fourth communicating-groove structure 230. In detail, in the present embodiment, the projection area of the first communicating-groove structure 120 and the second communicating-groove structure 130 of the first fin 100 in the second body 210 is overlapped with the second connecting-groove structure 240 respectively. The projection area of the third communicating-groove structure 220 and the fourth communicating-groove structure 230 of the second fin 200 in the first body 110 is overlapped with the first connecting-groove structure 140 respectively. Thus, the first communicating-groove structure 120, the second connecting-groove structure 240, and the second communicating-groove structure 130 constitute the first guiding-channel C1, and the third communicating-groove structure 220, the first connecting-groove structure 140, and the fourth communicating-groove structure 230 constitute the second guiding-channel C2.

Further, the projection area of the first communicating-groove structure 120 and the second communicating-groove structure 130 of the first fin 100 in the second body 210 is overlapped with two ends of the second connecting-groove structure 240 respectively. The projection area of the third communicating-groove structure 220 and the fourth communicating-groove structure 230 of the second fin 200 in the first body 110 is overlapped with two ends of the first connecting-groove structure 140 respectively. The projection area of two ends of the first connecting-groove structure 140 in the second body 210 is greater or equal to the area of the third communicating-groove structure 220 and the fourth communicating-groove structure 230 respectively. The projection area of two ends of the second connecting-groove structure 240 in first body 110 is greater or equal to the area of the first communicating-groove structure 120 and the second communicating-groove structure 130 respectively. Therefore, the second heat-exchange fluid F2 with higher temperature can flow to the first connecting-groove structure 140 from the third communicating-groove structure 220 smoothly, and then flow to the fourth communicating-groove structure 230 from the first connecting-groove structure 140. The first heat-exchange fluid F1 with lower temperature can flow to the second connecting-groove structure 240 from the first communicating-groove structure 120 smoothly, and then flow to the second communicating-groove structure 130 from the second connecting-groove structure 240.

In addition, in the present embodiment, the projection area of the first communicating-groove structure 120 and the second communicating-groove structure 130 of the first fin 100 in the second body 210 is not overlapped with the third communicating-groove structure 220 and the fourth communicating-groove structure 230. The projection area of the first connecting-groove structure 140 of the first fin 100 in the second body 210 is not overlapped with the second connecting-groove structure 240. That is, the first guiding-channel C1 and the second guiding-channel C2 are not communicated with each other when the first fin 100 and the second fin 200 are contacted along the assembly axis L1.

In the present embodiment, the first guiding-channel C1 is, for example, a 「 ⊔ 」 type guiding-channel. The second guiding-channel C2 is, for example, a 「 ⊓ 」 type guiding-channel. The across area of the first guiding-channel C1 is, for example, across the cross-section of the first heat-exchanger 10. Similarly, the across area of the second guiding-channel C2 also is, for example, across the cross-section of the first heat-exchanger 10. That is, the across area of the first guiding-channel C1 and the across area of the second guiding-channel C2 are similar substantially. Therefore, the first heat-exchange fluid F1 and the second heat-exchange fluid F2 can perform the heat-exchange practice effectively by flowing across the first heat-exchanger 10 completely. The guiding direction of the fluid in the first guiding-channel C1 and the guiding direction of the fluid in the second guiding-channel C2 are, for example, clockwise or counterclockwise simultaneously.

Next, other fins of the present embodiment will be illustrated as follow. The third fin 300 of the present embodiment has a first through hole 310 and a third through hole 320, and the fourth fin 400 has a second through hole 410 and a fourth through hole 320. The third fin 300 and the fourth fin 400 are, for example, disposed in two sides of the assembly of the first fin 100 and the second fin 200 along the assembly axis L1 respectively. The fifth fin 500 has a fifth through hole 510, a sixth through hole 520, a seventh through hole 530, and a eighth through hole 540. The fifth fin 500 is, for example, disposed between the first fin 100 and the second fin 200 along the assembly axis L1. One side of the fifth through hole 510 and one side of the sixth through hole 520 are, for example, communicated with the first communicating-groove structure 120 and the second communicating-groove structure 130 respectively. Another side of the fifth through hole 510 and another side of the sixth through hole 520 are, for example, communicated with two ends of the second connecting-groove structure 240 respectively. One side of the seventh through hole 530 and one side of the eighth through hole 540 are communicated with the third communicating-groove structure 220 and the fourth communicating-groove structure 230 respectively. Another side of the seventh through hole 530 and another side of the eighth through hole 540 are, for example, of communicated with two ends of the first connecting-groove structure 140 respectively.

From the above, the first through hole 310 and the third through hole 320 of the third fin 300 are, for example, connected to two ends of the first guiding-channel C1. The first through hole 310 is connected to the first inlet 12 of the first heat-exchanger 10, and the third through hole 320 is connected to the first outlet 14 of the first heat-exchanger 10. The second through hole 410 and the fourth through hole 320 of the fourth fin 400 are, for example, connected to two ends of the second guiding-channel C2. The first through hole 310 of the third fin 300 is communicated with the first communicating-groove structure 120 of the first fin 100. The third through hole 320 of the third fin 300 is communicated with the second communicating-groove structure 130 of the first fin 100. The second through hole 410 of the fourth fin 400 is communicated with the third communicating-groove structure 220 of the second fin 200. The fourth through hole 320 of the fourth fin 400 is communicated with the fourth communicating-groove structure 230 of the second fin 200. Since the first guiding-channel C1 and the second guiding-channel C2 are not communicated with each other, the projection area of the first through hole 310 and the third through hole 320 of the third fin 300 in the fourth fin 400 is not overlapped with the second through hole 410 and the fourth through hole 320.

Besides, the fifth through hole 510 and the sixth through hole 520 of the fifth fin 500 are communicated with the first guiding-channel C1, and the seventh through hole 530 and the eighth through hole 540 of the fifth fin 500 are communicated with the second guiding-channel C2. The fifth fin 500 disposed between the first fin 100 and the second fin 200 is provided for the first heat-exchange fluid F1 with lower temperature and the second heat-exchange fluid F2 with higher temperature to flow simultaneously, and increases the heat-exchange practice between the first heat-exchange fluid F1 and the second heat-exchange fluid F2.

In addition to the capability of providing the first heat-exchange fluid F1 with lower temperature and the second heat-exchange fluid F2 with higher temperature to flow in the fifth fin 500 simultaneously, since the first guiding-channel C1 for the first heat-exchange fluid F1 with lower temperature includes the first communicating-groove structure 120 of the first fin 100, the second communicating-groove structure 130 of the first fin 100, and the second connecting-groove structure 240 of the second fin 200, and the second guiding-channel C2 for the second heat-exchange fluid F2 with higher temperature includes the first connecting-groove structure 140 of the first fin 100, the third communicating-groove structure 220 of the second fin 200, and the fourth communicating-groove structure 230 of the second fin 200, the first fin 100 and the second fin 200 are also capable of flowing of the first heat-exchange fluid F1 with lower temperature and the second heat-exchange fluid F2 with higher temperature. Therefore, the design of the first fin 100 and the second fin 200 can increases the heat-exchange practice between the first heat-exchange fluid F1 and the second heat-exchange fluid F2. The first connecting-groove structure 140 like the wavy type structure in the first fin 100 and the second connecting-groove structure 240 like the wavy type structure in the second fin 200 like the wavy type structure further have the capability of making a constant turbulence of the first heat-exchange fluid F1 and the second heat-exchange fluid F2 to upgrade the heat-exchange efficiency. Thus, the first heat-exchanger 10 of the present embodiment has better heat-exchange performance.

The present embodiment takes the stagger of a first fin 100 and a second fin 200 along the assembly axis L1 mainly for example. In other embodiments, multiple first fins 100 can be assembled in advance, and multiple second fins 200 can be assembled in advance. And then, the assembly of the first fins 100 and the assembly of the second fins 200 can be staggered to constitute another heat-exchanger, and the present invention does not have any limitation. About the staggered method of the assembly of the first fins 100 and the second fins 200, the present invention does not have any limitation. In addition, the present embodiment is constituted of at least a first fin 100 and at least a second fin 200 mainly, the assembled type of the third fin 300, the fourth fin 400, and the fifth fin 500 opposite to the location of the first fin 100 and the second fin 200 as described in above is one of various embodiments. It is within the scope and spirit of the present invention as long as the appropriate disposing type for the first guiding-channel C1 and the second guiding-channel C2 flowing smoothly, and the present invention does not have any limitation.

Figure 3A:
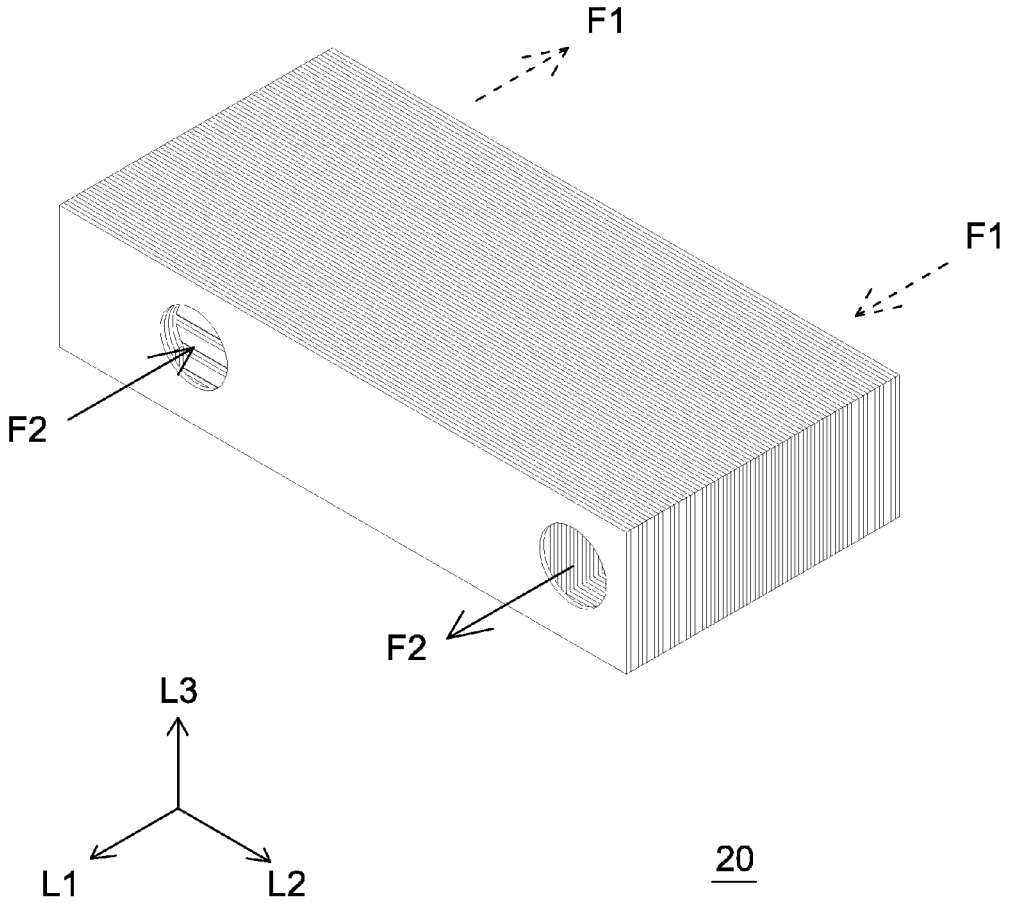
FIG. 3A is a schematic view illustrating the first heat-exchanger according to another embodiment of the present invention.
Figure 3B:
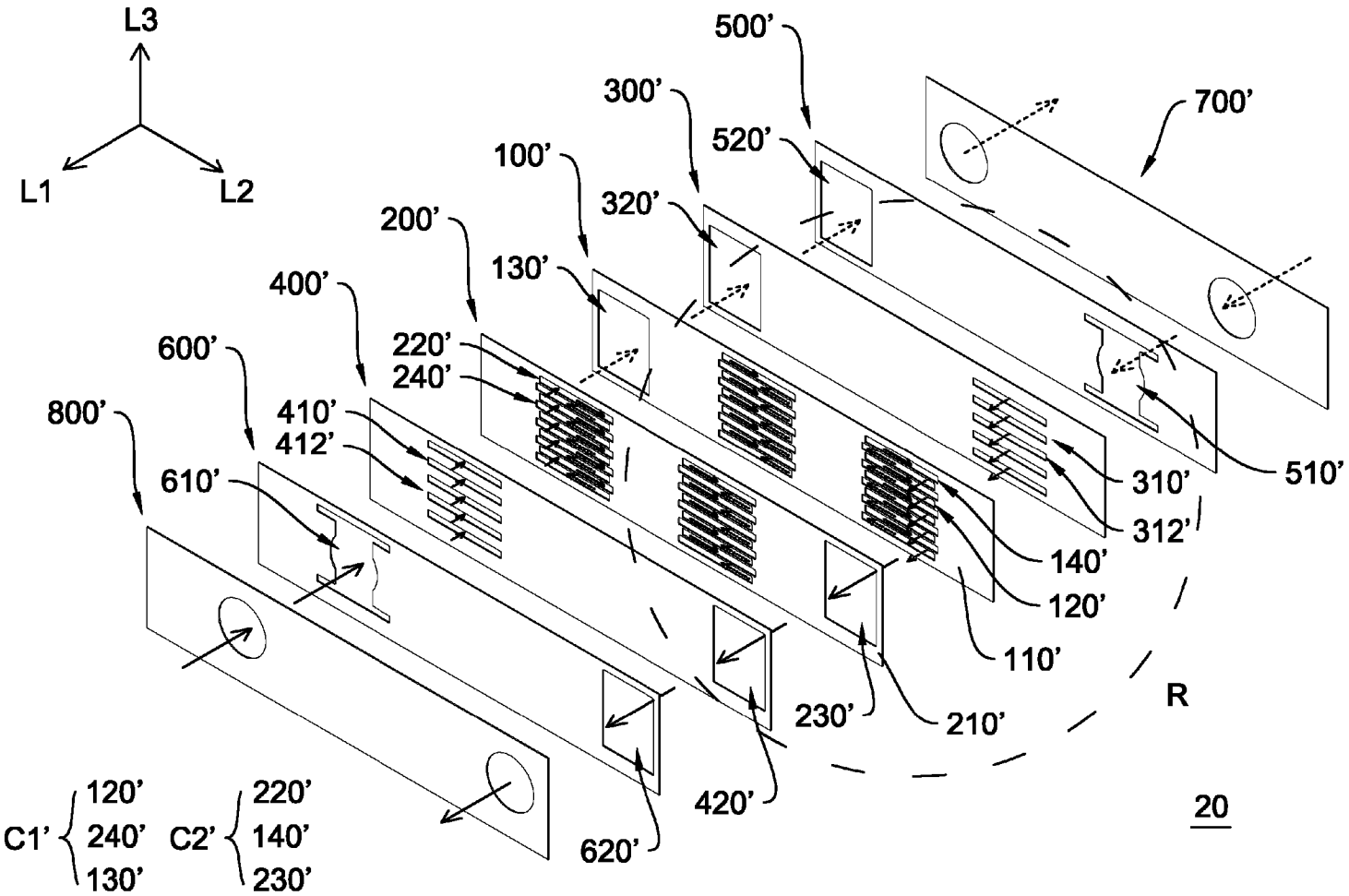
FIG. 3B is an exploded view illustrating the first heat-exchanger depicted in FIG. 3A.
Figure 3C:
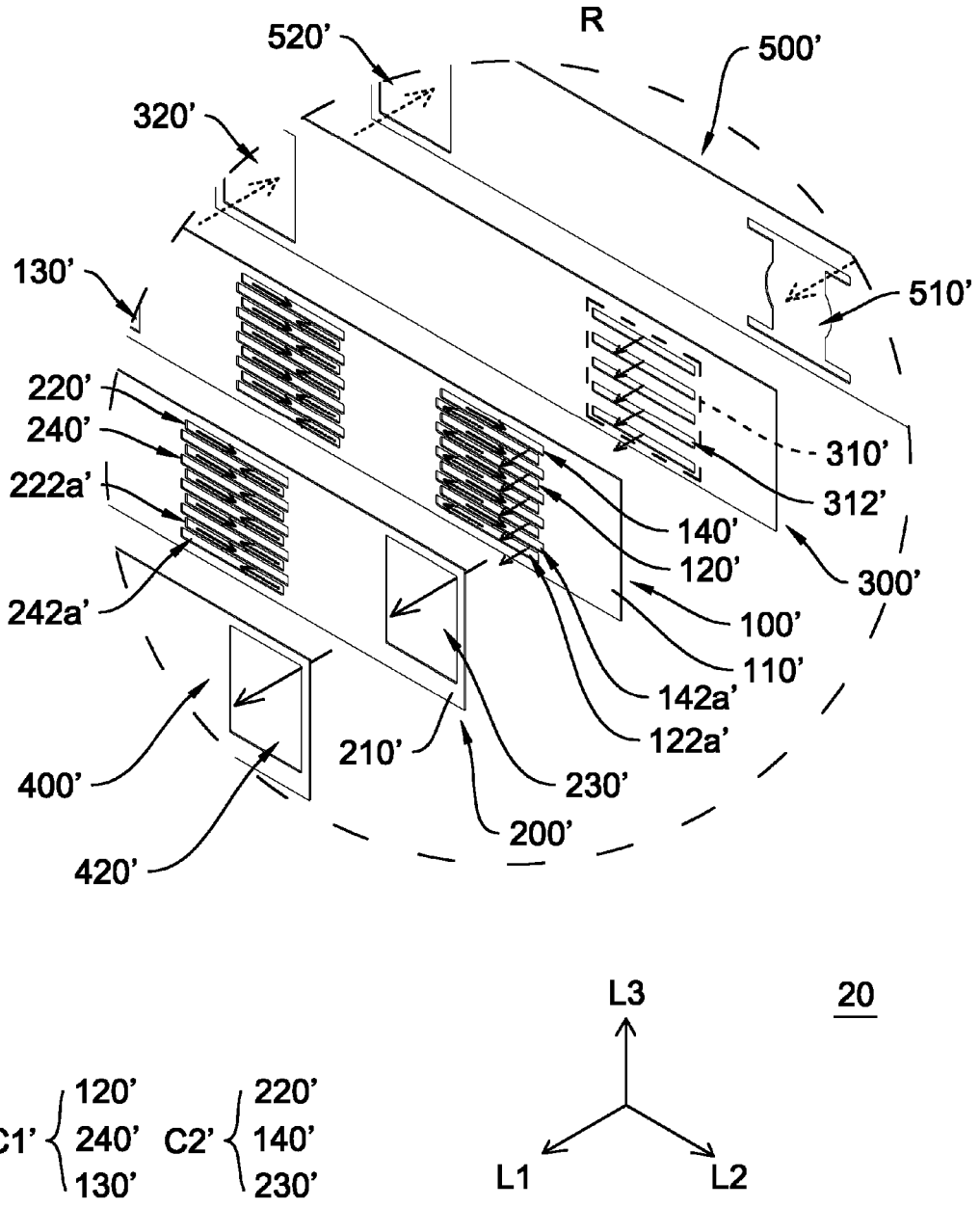
FIG. 3C is an enlarged schematic view illustrating a region of R depicted in FIG. 3B.
Figure 3D:
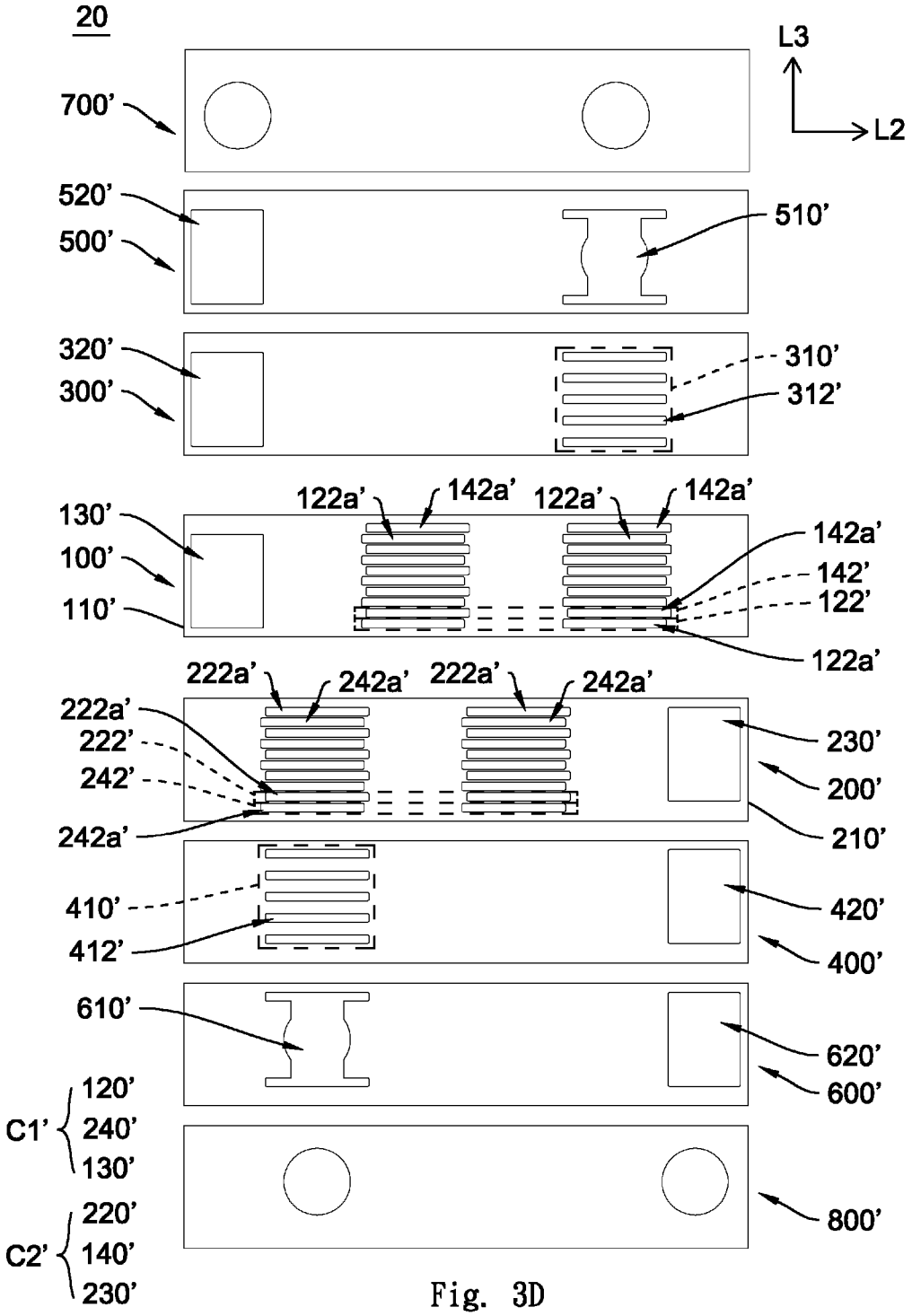
FIG. 3D is a plane schematic view illustrating the first heat-exchanger depicted in FIG. 3B.
Figure 3E:
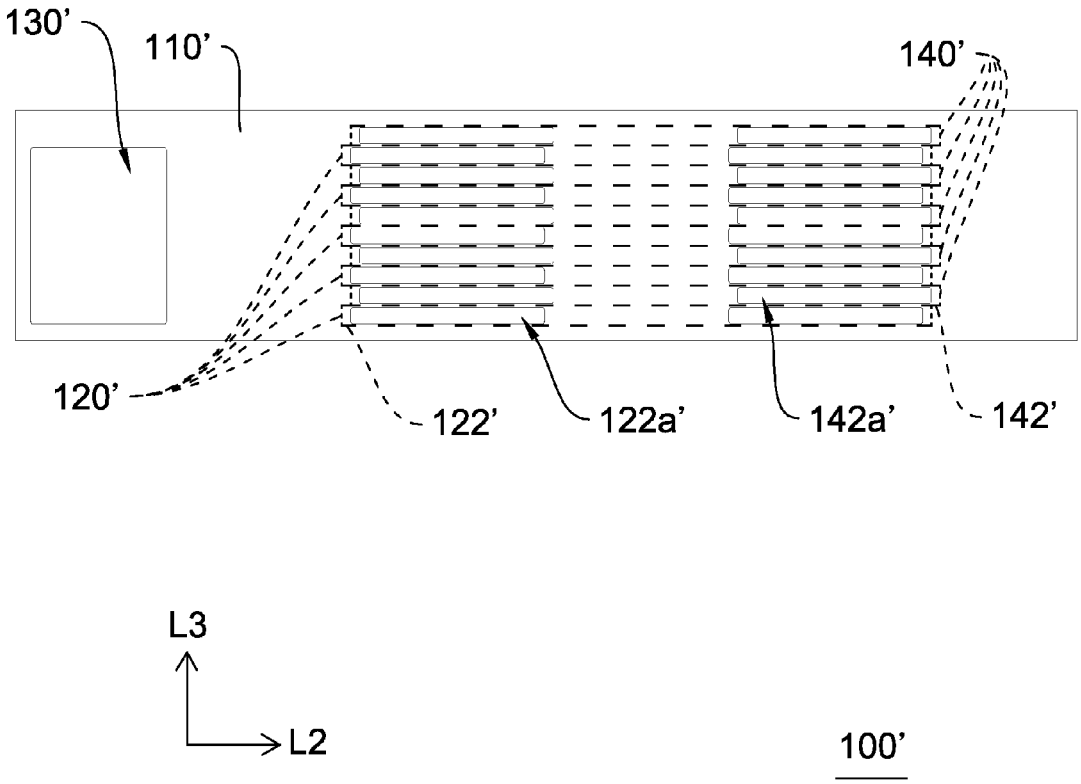
FIG. 3E is an enlarged schematic view illustrating the first fin depicted in FIG. 3D.
Figure 3F:
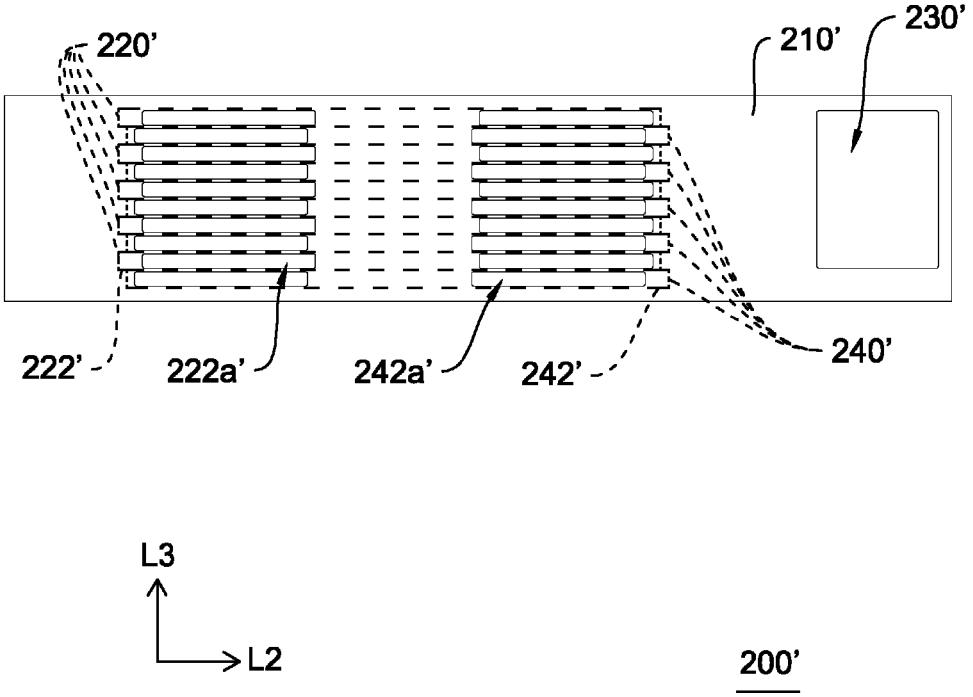
FIG. 3F is an enlarged schematic view illustrating the second fin depicted in FIG. 3D.

FIG. 3A is a schematic view illustrating the first heat-exchanger according to another embodiment of the present invention. FIG. 3B is an exploded view illustrating the first heat-exchanger depicted in FIG. 3A. FIG. 3C is an enlarged schematic view illustrating a region of R depicted in FIG. 3B. FIG. 3D is a plane schematic view illustrating the first heat-exchanger depicted in FIG. 3B. FIG. 3E is an enlarged schematic view illustrating the first fin depicted in FIG. 3D. FIG. 3F is an enlarged schematic view illustrating the second fin depicted in FIG. 3D. Referring to FIG. 3A, FIG. 3B, FIG. 3C, FIG. 3D, FIG. 3E, and FIG. 3F, the first heat-exchanger 10' of the present embodiment includes a first fin 100', a second fin 200', a third fin 300', a fourth fin 400', a fifth fin 500', and a sixth fin 600'. The first fin 100', the second fin 200', the third fin 300', the fourth fin 400', the fifth fin 500', and sixth fin 600' are, for example, rectangular sheets, and are contacted along an assembly axis L1.

The third fin 300' and the fourth fin 400' are disposed in two sides of the assembly of the first fin 100' and the second fin 200' along the assembly axis L1 respectively. The fifth fin 500' and sixth fin 600' are disposed in two sides of the assembly of the first fin 100', the second fin 200', the third fin 300', and the fourth fin 400' along the assembly axis L1 respectively. In the present embodiment, the second fin 200' is, for example, an inverted state of the first fin 100'. The inverted state is, for example, the state of the rotating 180 degrees of the first fin 100' along the assembly axis L1. The second fin 200' also be other inverted states of the first fin 100', including but not limited to this type. In addition, the fourth fin 400' is, for example, an inverted state of the third fin 300', and the sixth fin 600' is, for example, an inverted state of the fifth fin 500'.

The first heat-exchanger 10' of the present embodiment is constituted of at least a first fin 100' and at least a second fin 200' mainly, and the first fin 100' and the second fin 200' will be illustrated in detail as follow. The first fin 100' has a first body 110', a first communicating-groove structure 120', a second communicating-groove structure 130', and a first connecting-groove structure 140', wherein the first communicating-groove structure 120', the second communicating-groove structure 130', and the first connecting-groove structure 140' are disposed in first body 110'. In addition, the second fin 200' has a second body 210', a third communicating-groove structure 220', a fourth communicating-groove structure 230', and a second connecting-groove structure 240', wherein the third communicating-groove structure 220', the fourth communicating-groove structure 230', and the second connecting-groove structure 240' are disposed in the second body 210'.

When the first fin 100', the second fin 200', the third fin 300', the fourth fin 400', the fifth fin 500', and sixth fin 600' are contacted along the assembly axis L1, the second connecting-groove structure 240' is communicated with the first communicating-groove structure 120' and the second communicating-groove structure 130'. The first connecting-groove structure 140' is communicated with the third communicating-groove structure 220' and the fourth communicating-groove structure 230'. In detail, the first connecting-groove structure 140' is constituted of multiple first connecting-groove assemblies 142' arranged in the first body 110' along a disposing axis L3 in the present embodiment. The second connecting-groove structure 240' is constituted of multiple second connecting-groove assemblies 242' arranged in the second body 210' along the disposing axis L3. The disposing axis L3 is, for example, vertical to the assembly axis L1. One end of each second connecting-groove assembly 242' of the second fin 200' is overlapped with the first communicating-groove structure 120' of the adjacent first fin 100' along a connecting axis L2. The other end of the second connecting-groove assembly 242' is overlapped with the second communicating-groove structure 130' of the first fin 100'. One end of each first connecting-groove assembly 142' of the first fin 100' is overlapped with the third communicating-groove structure 220' of the adjacent second fin 200' along the connecting axis L2. The other end of the first connecting-groove assembly 142' is overlapped with the fourth communicating-groove structure 230' of the second fin 200'. Therefore, the first communicating-groove structure 120', the second connecting-groove structure 240', and the second communicating-groove structure 130' constitute the first guiding-channel C1', and the third communicating-groove structure 220', the first connecting-groove structure 140', and the fourth communicating-groove structure 230' constitute the second guiding-channel C2'. The assembly axis L1, the disposing axis L3, and the connecting axis L2 are, for example, vertical to each other.

Further, in the present embodiment, the projection area of the first communicating-groove structure 120' and the second communicating-groove structure 130' of the first fin 100' in the second body 210' is not overlapped with the third communicating-groove structure 220' and the fourth communicating-groove structure 230'. The projection area of the first connecting-groove structure 140' of the first fin 100' in the second body 210' is not overlapped with the second connecting-groove structure 240'. That is, when the first fin 100' and the second fin 200' are contacted along the assembly axis L1, the first guiding-channel C1' and the second guiding-channel C2' are not communicated with each other. Therefore, the second heat-exchange fluid F2 can flow to the first connecting-groove structure 140' from the third communicating-groove structure 220' smoothly, and flow to the fourth communicating-groove structure 230' from the first connecting-groove structure 140' smoothly. The first heat-exchange fluid F1 can flow to the second connecting-groove structure 240' from the first communicating-groove structure 120' smoothly, and flow to the second communicating-groove structure 130' from the second connecting-groove structure 240' smoothly.

Worth mentioning is that, the first connecting-groove structure 140' and the second connecting-groove structure 240' are constituted of multiple first connecting-groove assemblies 142' and multiple second connecting-groove assemblies 242' respectively, the first heat-exchange fluid F1 flowed into the first guiding-channel C1' and the second heat-exchange fluid F2 flow into the second guiding-channel C2' can be separated by the first connecting-groove assemblies 142' and the second connecting-groove assembly 242' respectively. Therefore, the heat-exchange efficiency between the heat-exchange fluid and fins is upgraded by the separations of the first heat-exchange fluid F1 flowed into the first guiding-channel C1' and the second heat-exchange fluid F2 flowed into the second guiding-channel C2'. The above separation further makes a heat-exchange efficiency between the first heat-exchange fluid F1 in the first guiding-channel C1' and the second heat-exchange fluid F2 in the second guiding-channel C2'.

In the present embodiment, the first guiding-channel C1' is, for example, capable of flowing for the first heat-exchange fluid F1 with lower temperature, and the second guiding-channel C2' is, for example, capable of flowing for the second heat-exchange fluid F2 with higher temperature. The first guiding-channel C1' is, for example, a 「 ⊔ 」 type guiding-channel. The second guiding-channel C2' is, for example, a 「 ⊓ 」 type guiding-channel. The across area of the first guiding-channel C1' is, for example, across the cross-section of the first heat-exchanger 10'. Similarly, the across area of the second guiding-channel C2' also is, for example, across the cross-section of the first heat-exchanger 10'. That is, the across area of the first guiding-channel C1' and the across area of the second guiding-channel C2' are similar substantially. Therefore, the first heat-exchange fluid F1 and the second heat-exchange fluid F2 can perform the heat-exchange practice effectively by flowing across the first heat-exchanger 10' completely. The guiding direction of the fluid in the first guiding-channel C1' and the guiding direction of the fluid in the second guiding-channel C2' are, for example, clockwise or counterclockwise simultaneously.

From the above, in order to have a better heat-exchange efficiency by frequent separations, the first communicating-groove structure 120' is also constituted of multiple first communicating-groove assemblies 122' arranged in the first body 110' along the disposing axis L3, and the third communicating-groove structure 220' is constituted of multiple third communicating-groove assemblies 222' arranged in the second body 210' along the disposing axis L3 in the present embodiment. One end of each second connecting-groove assembly 242' of the second fin 200' is overlapped with the first communicating-groove assembly 122' of the adjacent first fin 100' along the connecting axis L2, and the other end of the second connecting-groove assembly 242' is overlapped with the second communicating-groove structure 130' in the connecting axis L2 when the first fin 100' and the second fin 200' are contacted. Similarly, one end of each first connecting-groove assembly 142' of the first fin 100' is overlapped with the third communicating-groove assembly 222' of the adjacent second fin 200' along the connecting axis L2, and the other end of the first connecting-groove assembly 142' is overlapped with the fourth communicating-groove structure 230' along the connecting axis L2.

Especially, in order to increase the heat-exchange area between the heat-exchange fluid and the fin, each first communicating-groove assembly 122' of the present embodiment has at least a first communicating-groove unit 122*a*' arranged in the first body 110' along the connecting axis L2, each first connecting-groove assembly 142' has at least a first connecting-groove unit 142*a*' arranged in the first body 110' along the connecting axis L2, each third communicating-groove assembly 222' has at least a third communicating-groove unit 222*a*' arranged in the second body 210' along the connecting axis L2, and each second connecting-groove assembly 242' has at least a second connecting-groove unit 242*a*' arranged in the second body 210' along the connecting axis L2. The connecting-groove unit or the communicating-groove unit is, for example, a strip type structure or other appropriate structure.

One end of the second connecting-groove unit 242*a*' of the second fin 200' is overlapped with one end of the first communicating-groove unit 122*a*' of the adjacent first fin 100', and the other end of the second connecting-groove unit 242*a*' is overlapped with one end of another first communicating-groove unit 122*a*' of the first fin 100' or the second communicating-groove structure 130' of the first fin 100'. One end of the first connecting-groove unit 142*a*' of the first fin 100' is overlapped with one end of the third communicating-groove unit 222*a*' of the adjacent e second fin 200', and the other end of the first connecting-groove unit 142*a*' is overlapped with one end of another third communicating-groove unit 222*a*' of the second fin 200' or the fourth communicating-groove structure 230' of the second fin 200'. The two first communicating-groove units 122*a*' overlapped with the second connecting-groove unit 242*a*' are arranged in the first body 110' along the connecting axis L2 adjacently, and the two third communicating-groove units 222*a*' overlapped with the first connecting-groove unit 142*a*' are arranged in the second body 210' along the connecting axis L2 adjacently. It increases the heat-exchange area between the heat-exchange fluid and the fin substantially by the design of each groove assembly having at least a groove unit, and further upgrades the heat-exchange efficiency of the first heat-exchanger 10'. In the present embodiment, the first communicating-groove assembly 122' is, for example, constituted of two first communicating-groove units 122*a*'. The first connecting-groove assembly 142' is, for example, constituted of two first connecting-groove units 142*a*'. The third communicating-groove assembly 222' is, for example, constituted of two third communicating-groove units 222*a*'. The second connecting-groove assembly 242' is, for example, constituted of two second connecting-groove units 242*a*'. About the groove assembly is, for example, constituted of two groove units, the present invention does not have any limitation.

On the other hand, because of partial overlap between the end of the second connecting-groove unit 242*a*' and the end of the first communicating-groove unit 122*a*', partial overlap between the end of second connecting-groove unit 242*a*' and the end of the second communicating-groove structure 130', partial overlap between the end of the first connecting-groove unit 142*a*' and the end of the third communicating-groove unit 222*a*', and partial overlap between the end of the first connecting-groove unit 142*a*' and the end of the fourth communicating-groove structure 230', the heat-exchange fluid flowed to any connecting-groove unit or any communicating-groove unit be separated into two communicating-groove units with partial overlap or two connecting-groove units with partial overlap. The above heat-exchange fluid separated into two communicating-groove units or two connecting-groove units will be confluent to the connecting-groove unit overlapped with the two communicating-groove units simultaneously or the communicating-groove unit overlapped with the two communicating-groove units simultaneously. That is, the heat-exchange fluid will be separated and confluent in the process of flowing through each groove unit constantly. Therefore, there being have a maximum contact area between each fin and the heat-exchange fluid in the process of the heat-exchange fluid flowing through the first heat-exchanger 10'. The heat-exchange practice will be performed between the heat-exchange fluids flowing through each connecting-groove unit or communicating-groove unit and the first heat-exchanger 10', further make the first heat-exchanger 10' have a good heat-exchange efficiency.

Furthermore, in order to have a shorter and direct heat-exchange path between the first heat-exchange fluid F1 with lower temperature in the first guiding-channel C1' and the second heat-exchange fluid F2 with higher temperature in the second guiding-channel C2' in the present embodiment, the first communicating-groove assemblies 122' and the first connecting-groove assemblies 142' arranged in the first body 110' are staggered along the disposing axis L3, and the third communicating-groove assemblies 222' and the second connecting-groove assemblies 242' arranged in the second body 210' are staggered along the disposing axis L3 similarly. As a result, the first guiding-channel C1' and the second guiding-channel C2' are the relationship of the adjacent upper and lower. Therefore, there will be a shorter and direct heat-exchange path between the first heat-exchange fluid F1 with lower temperature in the first guiding-channel C1' and the second heat-exchange fluid F2 with higher temperature in the second guiding-channel C2', thereby allowing the heat-exchange practice of the first heat-exchanger 10' efficiently.

Next, other types of fins in the present embodiment will be illustrated. The third fin 300' of the present embodiment has a first through hole 310' and a third through hole 320', and the fourth fin 400' has a second through hole 410' and a fourth through hole 320'. The first through hole 310' and the third through hole 320' are connected to two ends of the first guiding-channel C1'. The first through hole 310' is connected to the first inlet 12, the third through hole 320' is connected to first outlet 14. The second through hole 410' and the fourth through hole 320' are connected to two ends of the second guiding-channel C2'. The first through hole 310' are the first communicating-groove structure 120' are communicated with each other, the third through hole 320' and the second communicating-groove structure 130' are communicated with each other, the second through hole 410' and the third communicating-groove structure 220' are communicated with each other, and the fourth through hole 320' and the fourth communicating-groove structure 230' are communicated with each other. The projection area of the first through hole 310' and the third through hole 320' of the third fin 300' in the fourth fin 400' is not overlapped with the second through hole 410' and the fourth through hole 320'. Similarly, in order to increase the heat-exchange area between the heat-exchange fluid and the fin, the first through hole 310' are also constituted of multiple first through hole units 312' arranged along the disposing axis L3, and the second through hole 410' are constituted of multiple second through hole units 412' arranged along the disposing axis L3. The projection area of the first through hole units 312' in first body 110' is overlapped with the first communicating-groove structure 120', and the projection area of the second through hole units 412' in the second body 210' is overlapped with the third communicating-groove structure 220'. That is, the first through hole units 312' and the first communicating-groove structure 120' are communicated with each other, and the second through hole units 412' and the third communicating-groove structure 220' are communicated with each other.

In addition, the fifth fin 500' has a fifth through hole 510' and a sixth through hole 520', and the sixth fin 600' has a third through hole 610' and a fourth through hole 620'. One side of the first through hole 310' is communicated with the first communicating-groove structure 120', and another side of the first through hole 310' is communicated with the fifth through hole 510'. One side of the third through hole 320' is communicated with the second communicating-groove structure 130', and another side of the third through hole 320' is communicated with the sixth through hole 520'. One side of the second through hole 410' is communicated with the third communicating-groove structure 220', and another side of the second through hole 410' is communicated with the third through hole 610'. One side of the fourth through hole 320' is communicated with the fourth communicating-groove structure 230', and another side of the fourth through hole 320' is communicated with the fourth through hole 620'.

Therefore, the first heat-exchange fluid F1 with lower temperature can flow into the first guiding-channel C1' through the fifth through hole 510' and the first through hole 310', and flows out of the first heat-exchanger 10' through the third through hole 320' and the sixth through hole 520' after flowing out of the first guiding-channel C1'. On the other hand, the second heat-exchange fluid F2 with higher temperature can flow into the second guiding-channel C2' through the third through hole 610' and the second through hole 410', and flows out of the first heat-exchanger 10' through the fourth through hole 320' and fourth through hole 620' after flowing out of the second guiding-channel C2'. By the above connection, the heat-exchange practice can be performed between the first heat-exchange fluid F1 with lower temperature and the second heat-exchange fluid F2 with higher temperature of the first heat-exchanger 10'. In the present embodiment, the first heat-exchanger 10' further includes a seventh fin 700' and an eighth fin 800'. The seventh fin 700' and the eighth fin 800' are disposed in two sides of the assembly of the first fin 100', the second fin 200', the third fin 300', the fourth fin 400', the fifth fin 500', and sixth fin 600' along the assembly axis L1, and the heat-exchange fluids can flow into or out of the first heat-exchanger 10' through a opening disposed in the seventh fin 700' or the eighth fin 800'.

The present embodiment takes the stagger of a first fin 100' and a second fin 200' along the assembly axis L1 mainly for example. In other embodiments, multiple first fins 100' can be assembled in advance, and multiple second fins 200' can be assembled in advance. And then, the assembly of the first fins 100' and the assembly of the second fins 200' can be staggered to constitute another heat-exchanger. About the staggered method of the assembly of the first fins 100' and the second fins 200', the present invention does not have any limitation. In addition, the present embodiment is constituted of at least a first fin 100' and at least a second fin 200' mainly, the assembled type of the third fin 300', the fourth fin 400', the fifth fin 500', the fifth fin 500', the sixth fin 600', the seventh fin 700', and the eighth fin 800' opposite to the location of the first fin 100' and the second fin 200' as described in above is one of various embodiments. It is within the scope and spirit of the present invention as long as the appropriate disposing type for the first guiding-channel C1' and the second guiding-channel C2' flowing smoothly, and the present invention does not have any limitation.

Figure 4A:
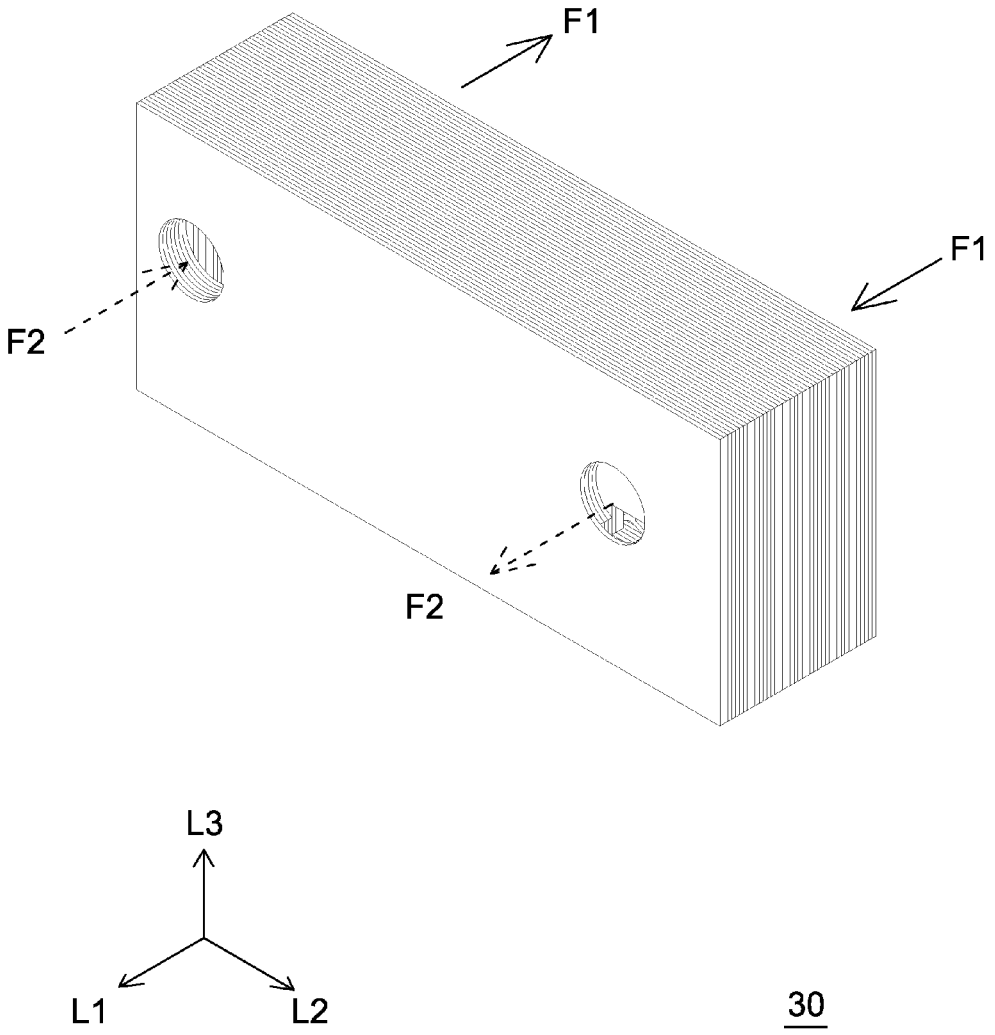
FIG. 4A is a schematic view illustrating another heat-exchanger according to one embodiment of the present invention.
Figure 4B:
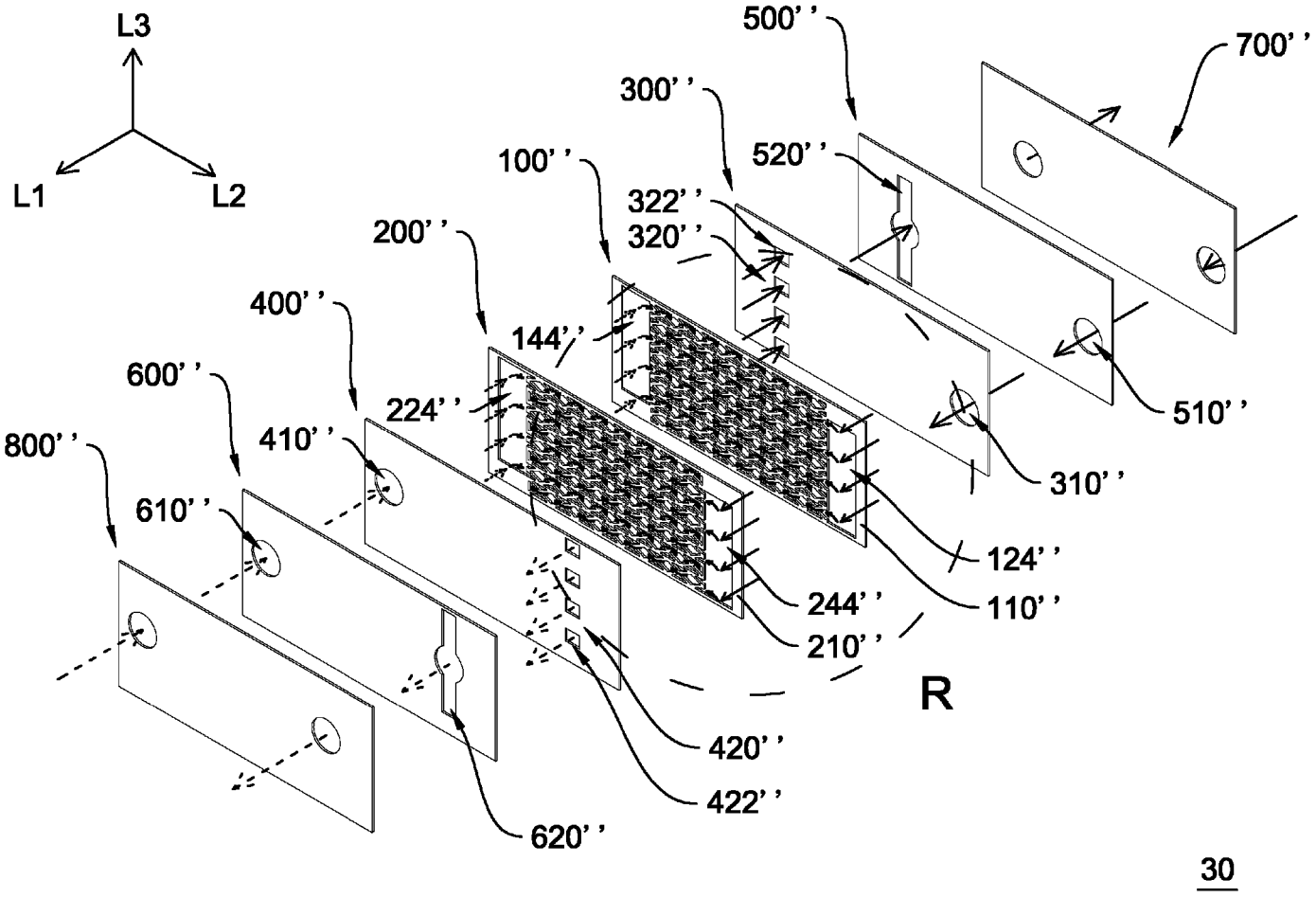
FIG. 4B is an exploded view illustrating the heat-exchanger depicted in FIG. 4A.
Figure 4C:
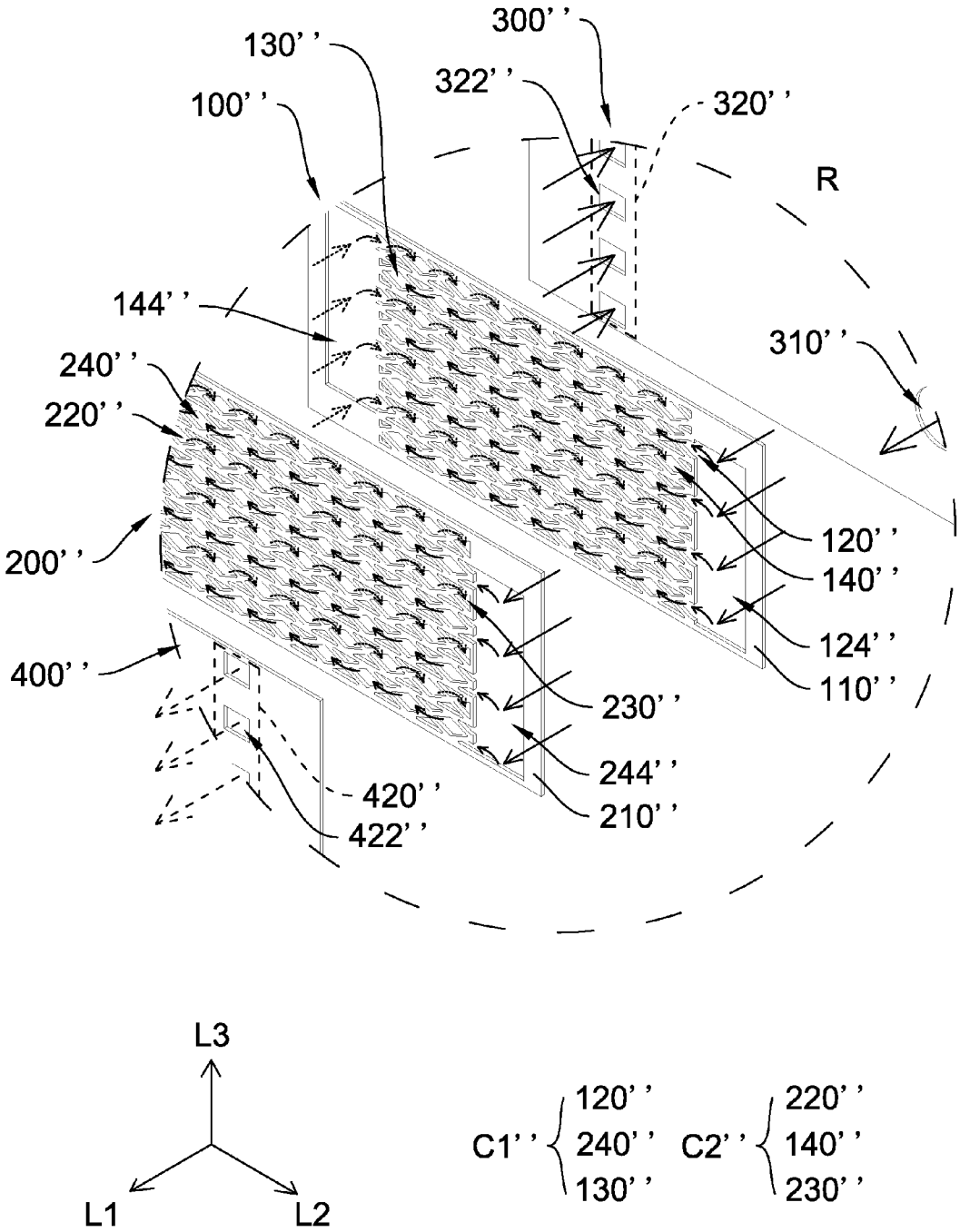
FIG. 4C is an enlarged schematic view illustrating a region of R depicted in FIG. 4B.
Figure 4D:
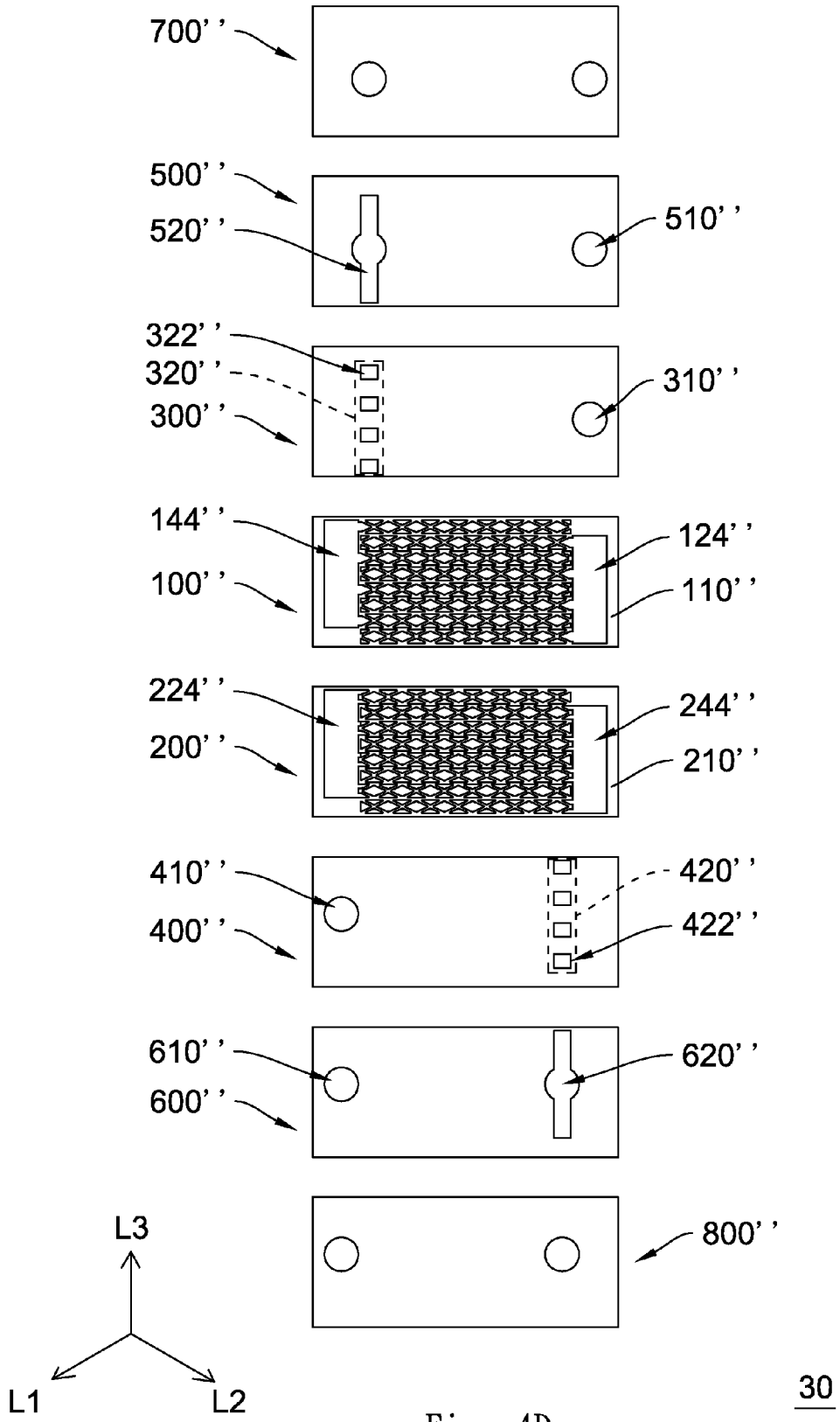
FIG. 4D is a plane schematic view illustrating the heat-exchanger depicted in FIG. 4B.
Figure 4E:
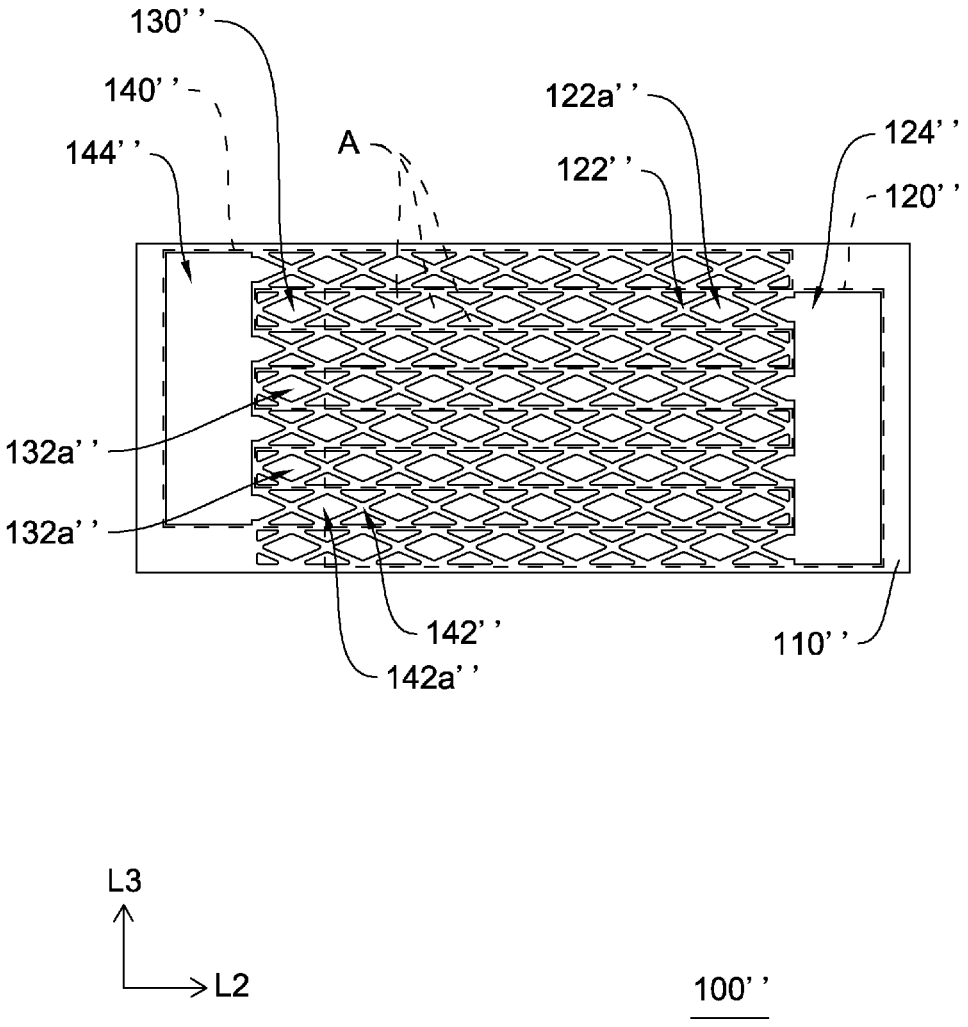
FIG. 4E is an enlarged schematic view illustrating the first fin depicted in FIG. 4D.
Figure 4F:
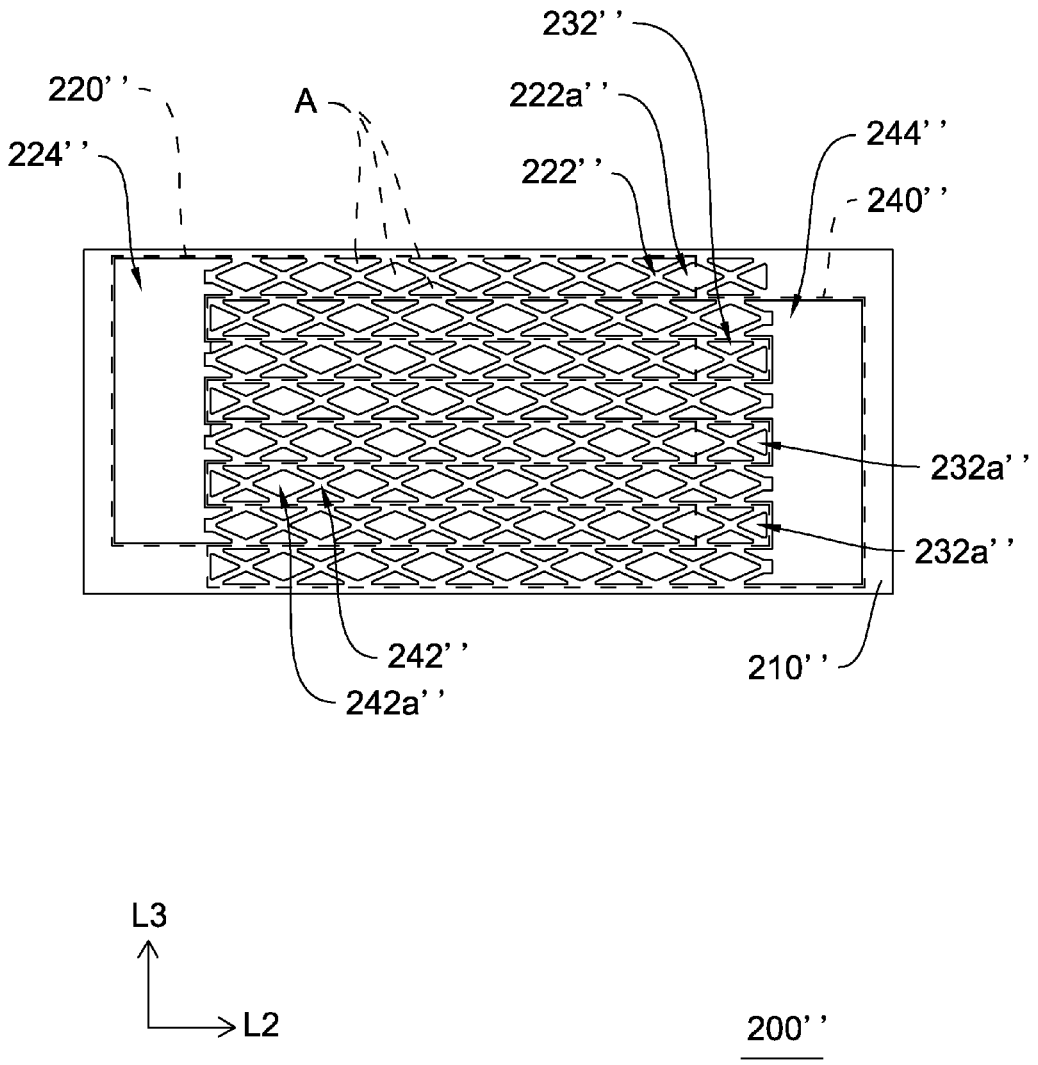
FIG. 4F is an enlarged schematic view illustrating the second fin depicted in FIG. 4D.
Figure 4G:
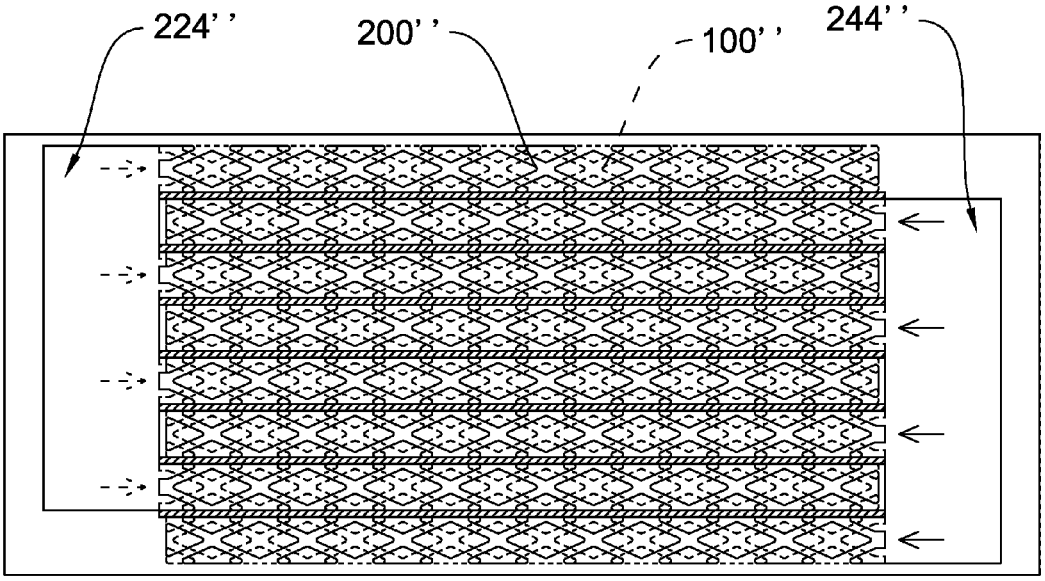
FIG. 4G is a schematic view illustrating a stack of the first fin depicted in FIG. 4E and the second fin depicted in FIG. 4F.
Figure 4G:
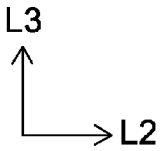

FIG. 4A is a schematic view illustrating another first heat-exchanger according to one embodiment of the present invention. FIG. 4B is an exploded view illustrating the first heat-exchanger depicted in FIG. 4A. FIG. 4C is an enlarged schematic view illustrating a region of R depicted in FIG. 4B. FIG. 4D is a plane schematic view illustrating the first heat-exchanger depicted in FIG. 4B. FIG. 4E is an enlarged schematic view illustrating the first fin depicted in FIG. 4D. FIG. 4F is an enlarged schematic view illustrating the second fin depicted in FIG. 4D. FIG. 4G is a schematic view illustrating a stack of the first fin depicted in FIG. 4E and the second fin depicted in FIG. 4F. Referring to FIG. 4A, FIG. 4B, FIG. 4C, FIG. 4D, FIG. 4E, FIG. 4F, and FIG. 4G, the first heat-exchanger 10" of the present embodiment includes a first fin 100", a second fin 200", a third fin 300", a fourth fin 400", a fifth fin 500", and a sixth fin 600". The first fin 100", the second fin 200", the third fin 300", the fourth fin 400", the fifth fin 500", and sixth fin 600" are, for example, rectangular sheets, and contacted along the assembly axis L1.

The third fin 300" and the fourth fin 400" are disposed in two sides of the assembly of the first fin 100" and the second fin 200" along the assembly axis L1 respectively, and the fifth fin 500" and the sixth fin 600" are disposed in two sides of the assembly of the first fin 100", the second fin 200", the third fin 300", and the fourth fin 400" along the assembly axis L1 respectively. In the present embodiment, the second fin 200" is, for example, an inverted state of the first fin 100". The inverted state is, for example, the state of the rotating 180 degrees of the first fin 100" along the assembly axis L1. The second fin 200" also be other inverted state of the first fin 100", including but not limited to this type. In addition, the fourth fin 400" is, for example, an inverted state of the third fin 300", and the sixth fin 600" is, for example, an inverted state of the fifth fin 500".

The first heat-exchanger 10" of the present embodiment is constituted of at least a first fin 100" and at least a second fin 200" mainly, and the first fin 100" and the second fin 200" will be illustrated in detail as follow. The first fin 100" has a first body 110", a first communicating-groove structure 120", a second communicating-groove structure 130", and a first connecting-groove structure 140", wherein the first communicating-groove structure 120", the second communicating-groove structure 130", and the first connecting-groove structure 140" are disposed in first body 110", The first communicating-groove structure 120" has multiple first communicating-groove assemblies 122" arranged in the first body 110" along the disposing axis L3, and the first connecting-groove structure 140" has multiple first connecting-groove assemblies 142" arranged in the first body 110" along the disposing axis L3. Each first communicating-groove assembly 122" has multiple first communicating-groove units 122*a*" arranged in the first body 110" along a connecting axis L2, and each first connecting-groove assembly 142" has multiple first connecting-groove units 142*a*" arranged in the first body 110" along the connecting axis L2. In addition, the second communicating-groove structure 130" is, for example, constituted of multiple second communicating-groove units 132*a*" arranged in the first body 110" along the disposing axis L3. Each second communicating-groove unit 132*a*" is, for example, arranged in one side of the corresponding first communicating-groove assembly 122" along the connecting axis L2.

Each second fin 200" has a second body 210", a third communicating-groove structure 220", a fourth communicating-groove structure 230", and a second connecting-groove structure 240", wherein the third communicating-groove structure 220", the fourth communicating-groove structure 230", and the second connecting-groove structure 240" are disposed in the second body 210". The third communicating-groove structure 220" has multiple third communicating-groove assemblies 222" arranged in the second body 210" along the disposing axis L3, and the second connecting-groove structure 240" has multiple second connecting-groove assemblies 242" arranged in the second body 210" along the disposing axis L3. Each third communicating-groove assembly 222" has multiple third communicating-groove unit 222*a*" arranged in the second body 210" along the connecting axis L2, and each second connecting-groove assembly 242" has multiple second connecting-groove units 242*a*" arranged in the second body 210" along the connecting axis L2. Besides, the fourth communicating-groove structure 230" is, for example, constituted of multiple fourth communicating-groove units 232*a*" arranged in the second body 210" along the disposing axis L3. Each fourth communicating-groove unit 232*a*" is, for example, arranged in one side of the corresponding third communicating-groove assembly 222" along the connecting axis L2.

In the first heat-exchanger 10' of the above embodiment, the connecting-groove unit or the communicating-groove unit is, for example, a strip type structure. But in the first heat-exchanger 10" of the present embodiment, the connecting-groove unit or the communicating-groove unit is, for example, diamond type structure. That is, the first communicating-groove unit 122*a*", the third communicating-groove unit 222*a*", the first connecting-groove unit 142*a*", and the second connecting-groove unit 242*a*" are, for example, diamond type structures. The connecting-groove unit or the communicating-groove unit of the present embodiment can be a circular type structure or a triangular type structure, the present invention does not have any limitation.

From the above, in the first fin 100", the first communicating-groove structure 120" also includes a first mainstream channel 124", and the first communicating-groove assembly 122" is, for example, a tributary channel. The tributary channels constituted of the first communicating-groove assemblies 122" are connected with the first mainstream channel 124" along the connecting axis L2. The first connecting-groove structure 140" further includes a second mainstream channel 144", and each first connecting-groove assembly 142" is, for example, a tributary channel, the tributary channels constituted of the first connecting-groove assemblies 142" are connected with the second mainstream channel 144" along the connecting axis L2. The second communicating-groove structure 130" is disposed between the second mainstream channel 144" and the first communicating-groove structure 120". In detail, each second communicating-groove unit 132*a*" is disposed between the second mainstream channel 144" and the corresponding first communicating-groove assembly 122".

Similarly, in the second fin 200", the third communicating-groove structure 220" further includes a third mainstream channel 224", and each third communicating-groove assembly 222" is, for example, a tributary channel. The tributary channels constituted of the third communicating-groove assemblies 222" are connected with the third mainstream channel 224" along the connecting axis L2. The second connecting-groove structure 240" further includes a fourth mainstream channel 244", and each second connecting-groove assembly 242" is, for example, a tributary channel. The tributary channels constituted of the second connecting-groove assemblies 242" are connected with the fourth mainstream channel 244" along the connecting axis L2. The fourth communicating-groove structure 230" is disposed between the fourth mainstream channel 244" and the third communicating-groove structure 220". In detail, each fourth communicating-groove unit 232*a*" is disposed between the fourth mainstream channel 244" and the corresponding third communicating-groove assembly 222".

The first communicating-groove structure 120", the first connecting-groove structure 140", the third communicating-groove structure 220", the second connecting-groove structure 240" are, for example, similar to the "claw" type structure or the "E" type structure. The first communicating-groove structure 120" and the first connecting-groove structure 140" are embedded with each other in first body 110", and the third communicating-groove structure 220" and the second connecting-groove structure 240" are embedded with each other in the second body 210". That is, in the first body 110", one first communicating-groove structure 120" is disposed between two first connecting-groove structures 140", and one first connecting-groove structure 140" is disposed between two first communicating-groove structures 120". Similarly, in the second body 210", one third communicating-groove structures 220" is disposed between two second connecting-groove structure 240", and one second connecting-groove structure 240" is disposed between two third communicating-groove structures 220".

When the first fin 100", the second fin 200", the third fin 300", the fourth fin 400", the fifth fin 500", and the sixth fin 600" are contacted along the assembly axis L1, the projection area of the second connecting-groove structure 240" in first body 110" is overlapped with the first communicating-groove structure 120" and the second communicating-groove structure 130", and the projection area of the first connecting-groove structure 140" in the second body 210" is overlapped with the third communicating-groove structure 220" and the fourth communicating-groove structure 230". Further, one end of each second connecting-groove assembly 242" of the second fin 200" is overlapped with the first communicating-groove structure 120" of the adjacent the first fin 100" along the connecting axis L2. The other end of the second connecting-groove assembly 242" is overlapped with the second communicating-groove structure 130" of the first fin 100", and the first mainstream channel 124" and the fourth mainstream channel 244" are communicated with each other. In addition, one end of each first connecting-groove assembly 142" of the first fin 100" is overlapped with the third communicating-groove structure 220" of the adjacent second fin 200" along the connecting axis L2. The other end of the first connecting-groove assembly 142" is overlapped with the fourth communicating-groove structure 230" of the second fin 200", and the third mainstream channel 224" and the second mainstream channel 144" are communicated with each other. That is, the second connecting-groove assemblies 242" are adapt to communicate with the first communicating-groove structure 120", and the second communicating-groove structure 130" and the first connecting-groove assemblies 142" are adapt to communicate with the third communicating-groove structure 220" and the fourth communicating-groove structure 230".

Besides, because of the first communicating-groove structure 120" having multiple first communicating-groove assemblies 122" arranged in the first body 110" along the disposing axis L3 and each first communicating-groove assembly 122" having multiple first communicating-groove units 122*a*" arranged in the first body 110" along the connecting axis L2, one end of the second connecting-groove unit 242*a*" of the second fin 200" is overlapped with one end of the first communicating-groove unit 122*a*" of the adjacent first fin 100". The other end of the second connecting-groove unit 242*a*" is overlapped with one end of another first communicating-groove unit 122*a*" of the first fin 100" or the second communicating-groove structure 130" of the first fin 100".

Similarly, because of the third communicating-groove structure 220" having multiple third communicating-groove assemblies 222" arranged in the second body 210" along the disposing axis L3 and each third communicating-groove assembly 222" having multiple third communicating-groove units 222*a*" arranged in the second body 210" along the connecting axis L2, one end of the first connecting-groove unit 142*a*" of the first fin 100" is overlapped with one end of the third communicating-groove unit 222*a*" of the adjacent second fin 200". The other end of the first connecting-groove unit 142*a*" is overlapped with one end of another third communicating-groove unit 222*a*" of the second fin 200" or the fourth communicating-groove structure 230" of the second fin 200". The two first communicating-groove units 122*a*" overlapped with the second connecting-groove unit 242*a*" are arranged in the first body 110" along the connecting axis L2 adjacently. The two third communicating-groove units 222*a*" overlapped with the first connecting-groove unit 142*a*" are arranged in the second body 210" along the connecting axis L2 adjacently.

As a result, the first guiding-channel C1" is constituted of the first communicating-groove structure 120", the second connecting-groove structure 240", and the second communicating-groove structure 130", and the second guiding-channel C2" is constituted of the third communicating-groove structure 220", the first connecting-groove structure 140", and the fourth communicating-groove structure 230". The assembly axis L1, the disposing axis L3, and the connecting axis L2 are, for example, vertical to each other.

In addition, in the present embodiment, the first guiding-channel C1" is, for example, capable of flowing for the first heat-exchange fluid F1 with lower temperature, and the second guiding-channel C2" is, for example, capable of flowing for the second heat-exchange fluid F2 with higher temperature. The first guiding-channel C1" is, for example, a「⊔」type guiding-channel. The second guiding-channel C2" is, for example, a「⊓」type guiding-channel. The across area of the first guiding-channel C1" is, for example, across the cross-section of the first heat-exchanger 10". Similarly, the across area of the second guiding-channel C2" also is, for example, across the cross-section of the first heat-exchanger 10". That is, the across area of the first guiding-channel C1" and the across area of the second guiding-channel C2" are similar substantially. Therefore, the first heat-exchange fluid F1 and the second heat-exchange fluid F2 can perform the heat-exchange practice effectively by flowing across the first heat-exchanger 10" completely.

Different from the first heat-exchanger 10' of the above embodiment, in the present embodiment, multiple groove units arranged along the connecting axis L2 can be defined to a groove unit arrangement, and each groove assembly is constituted of multiple groove unit arrangements A. One groove assembly is constituted of the adjacent groove unit arrangements A staggered with each other. That is, the first communicating-groove unit 122*a*" of each first communicating-groove assembly 122" is staggered with the adjacent first communicating-groove unit 122*a*", the first connecting-groove unit 142*a*" of each first connecting-groove assembly 142" is staggered with the adjacent first connecting-groove unit 142*a*", the third communicating-groove unit 222*a*" of each third communicating-groove assembly 222" is staggered with the adjacent third communicating-groove unit 222*a*", and the second connecting-groove unit 242*a*" of each second connecting-groove assembly 242" is staggered with the adjacent second connecting-groove unit 242*a*".

Therefore, when the first fin 100" and the second fin 200" are contacted along the assembly axis L1, the second connecting-groove unit 242*a*" of the second fin 200" is communicated with the two adjacent first communicating-groove units 122*a*" arranged along the disposing axis L3 and the two adjacent first communicating-groove units 122*a*" arranged along the connecting axis L2 in the first fin 100", the first connecting-groove unit 142*a*" of the first fin 100" is communicated with the two adjacent third communicating-groove units 222*a*" arranged along the disposing axis L3 and the two adjacent third communicating-groove units 222*a*" arranged along the connecting axis L2 in the second fin 200". That is, one second connecting-groove unit 242*a*" is communicated with four adjacent first communicating-groove units 122*a*" of the first fin 100", and one first connecting-groove unit 142*a*" is communicated with four adjacent third communicating-groove units 222*a*" of the second fin 200". Although the above illustration take one connecting-groove unit communicated with adjacent four communicating-groove units for example, but the design of one connecting-groove unit communicated with adjacent four communicating-groove units are all within the spirit and scope of this invention, including but not limited to this type.

From the above, the present embodiment also has better heat-exchange efficiency by the design of one connecting-groove unit communicated with multiple adjacent communicating-groove units and frequent flow separation. The design of each groove assembly constituted of multiple groove units further increases the heat-exchange area between the heat-exchange fluid and the fin substantially, and upgrades the heat-exchange efficiency of the first heat-exchanger 10". In addition, because of one end of the two connected groove units overlapped with each other partially in the present embodiment, the heat-exchange fluid flowed to the connecting-groove unit or the communicating-groove unit will be separated or confluent continuously by the groove wall as described in above embodiment. Therefore, in the process of the heat-exchange fluid flowing through the first heat-exchanger 10", there will be a largest contact area between each fin and the heat-exchange fluid, and the first heat-exchanger 10" can perform the heat-exchange practice in each connecting-groove unit or communicating-groove unit with the heat-exchange fluid, and make the first heat-exchanger 10" have a good heat-exchange efficiency.

Worth mentioning is that the groove units of the present embodiment are, for example, a diamond type structure. The inner wall of the groove unit has at least a slope structure, so that the heat-exchange fluid will separated toward multiple directions after the heat-exchange fluid colliding with the end of the groove unit. There will be produced a serious turbulence to make the heat-exchange fluid in one section perform the heat-exchange stably.

Afterwards, other fins of the present embodiment will be illustrated as follow. The third fin 300" of the present embodiment has a first through hole 310" and a third through hole 320", and the fourth fin 400" has a second through hole 410" and a fourth through hole 320". The first through hole 310" and the third through hole 320" are connected to two ends of the first guiding-channel C1". The first through hole 310" is connected to the first inlet 12, the third through hole 320" is connected to the first outlet 14. The second through hole 410" and the fourth through hole 320" are connected to two ends of the second guiding-channel C2". The third through hole 320" of the third fin 300" is, for example, constituted of multiple third through hole units 322" arranged along the disposing axis L3. The fourth through hole 320" is, for example, constituted of multiple fourth through hole unit 422" arranged along the disposing axis L3. The projection area of the third through hole units 322" in first body 110" is overlapped with the second communicating-groove structure 130", and the projection area of the fourth through hole unit 422" in the second body 210" is overlapped with the fourth communicating-groove structure 230". the projection area of the first through hole 310" and the third through hole 320" of the third fin 300" in the fourth fin 400" is not overlapped with the second through hole 410" and the fourth through hole 320".

Therefore, when the third fin 300" and the fourth fin 400" are disposed in two sides of the assembly of the first fin 100" and the second fin 200" along the assembly axis L1 respectively, the third through hole units 322" and the second communicating-groove structure 130" are communicated with each other, and the fourth through hole units 422" and the fourth communicating-groove structure 220" are communicated with each other. That is, the third through hole 320" is communicated with the second communicating-groove structure 130", and the fourth through hole 320" is communicated with the fourth communicating-groove structure 230". In addition, in the present embodiment, the first through hole 310" is communicated with the first communicating-groove structure 120", and the second through hole 410" is communicated with the third communicating-groove structure 220". The third through hole 320" of the third fin 300" is, for example, constituted of multiple third through hole units 322" arranged along the disposing axis L3. The fourth through hole 420" is, for example, constituted of multiple fourth through hole units 422" arranged along the disposing axis L3. The design can increase the heat-exchange area between the heat-exchange fluid and the fin.

In addition, the fifth fin 500" has a fifth through hole 510" and a sixth through hole 520", the sixth fin 600" has a third through hole 610" and a fourth through hole 620", one side of the first through hole 310" is communicated with the first communicating-groove structure 120", another side of the first through hole 310" is communicated with the fifth through hole 510", one side of the third through hole 320" is communicated with the second communicating-groove structure 130", another side of the third through hole 320" is communicated with the sixth through hole 520", one side of the second through hole 410" is communicated with the third communicating-groove structure 220", another side of the second through hole 410" is communicated with the third through hole 610", one side of the fourth through hole 320" is communicated with the fourth communicating-groove structure 230", another side of the fourth through hole 320" is communicated with the fourth through hole 620".

As a result, the first heat-exchange fluid F1 with lower temperature can flow into the first guiding-channel C1' through the fifth through hole 510" and the first through hole 310", and flow out of the first heat-exchanger 10" through the third through hole 320" and the sixth through hole 520" after flowing out of the first guiding-channel C1". On the other hand, the second heat-exchange fluid F2 with higher temperature can flow into the second guiding-channel C2" through the third through hole 610" and the second through hole 410", and flow out of the first heat-exchanger 10" through the fourth through hole 320" and fourth through hole 620" after flowing out of the second guiding-channel C2". By the above connection, the heat-exchange practice can be performed between the first heat-exchange fluid F1 with lower temperature and the second heat-exchange fluid F2 with higher temperature of the first heat-exchanger 10'. Similar to the first heat-exchanger 10' of the above embodiment, the first heat-exchanger 10" of the present embodiment further includes a seventh fin 700" and a eighth fin 800". The seventh fin 700" and the eighth fin 800" are disposed in two sides of the assembly of the first fin 100", the second fin 200", the third fin 300", the fourth fin 400", the fifth fin 500", and sixth fin 600" along the assembly axis L1, and the heat-exchange fluids can flow into or out of the first heat-exchanger 10" through a opening disposed in the seventh fin 700" or the eighth fin 800".

The present embodiment takes the stagger of a first fin 100" and a second fin 200" along the assembly axis L1 mainly. In other embodiments, multiple first fins 100" can be assembled in advance, and multiple second fins 200" can be assembled in advance. And then, the assembly of the first fins 100" and the assembly of the second fins 200" can be staggered to constitute another heat-exchanger. About the staggered method of the assembly of the first fins 100" and the second fins 200", the present invention does not have any limitation. In addition, the present embodiment is constituted of at least a first fin 100" and at least a second fin 200" mainly, the assembled type of the third fin 300", the fourth fin 400", the fifth fin 500", the sixth fin 600", the seventh fin 700", and the eighth fin 800" opposite to the location of the first fin 100" and the second fin 200" as described in above is one of various embodiments. It is within the scope and spirit of the present invention as long as the appropriate disposing type for the first guiding-channel C1" and the second guiding-channel C2" flowing smoothly, and the present invention does not have any limitation.

Whether the heat-exchanger 10, the heat-exchanger 10', or the heat-exchanger 10" also has a good heat-exchange efficiency, and make the water dispenser 1 or the water dispenser 1' of the invention upgrade the heat-exchange efficiency efficiently and substantially.

To sum up, in the invention of the water dispenser, the water in the water dispenser can keep in a predetermined temperature by the configuration of the assembly components of the water dispenser, the additional hot water, and a heat-exchanger having a good heat-exchange efficiency. Therefore, when the user want to drink the hot water, the warm water, or the cold water, the demand water will be provided by the water dispenser effectively and quickly, while both energy-saving efficiency.

In detail, the demand amount of hot water may be less than the predetermined amount provided by the water dispenser in the process of drinking hot water, and the invention applies the additional hot water to heat exchange with the water at normal temperature. Thus, users can get warm water quickly. The above heat exchange practice can save energy substantially, and has no demand to heat the water at normal temperature for getting warm water frequently.

In the design of the heat-exchanger, at least two fins are set with multiple communicating-groove structures and connecting-groove structure in the heat-exchanger respectively. In each fin, a communicating-groove structure is not communicated with a connecting-groove structure, and one communicating-groove structure is not communicated with another communicating-groove structure. When the fins are assembled, a communicating-groove structure of one fin is communicated with the adjacent communicating-groove structure through a connecting-groove structure of another fin. A guiding-channel can be constitute of the communicating-groove structures of one fin and the connecting-groove structure of the adjacent fin after the assembly of the fins, wherein there are two guiding-channels in the heat-exchanger of the present invention for executing the heat exchange practice between two fluids with different temperatures.

In addition, since the heat-exchanger of the invention is assembled by at least two types of fins staggered with each other and each fin has multiple communicating-groove structures and a connecting-groove structure, the heat-exchange fluid is forced to be confluent or separated constantly when The heat-exchange fluid flows into the heat-exchanger. This increases the contact area between the heat-exchange fluid and heat-exchanger substantially, and increases the rate of the heat-exchange practice of heat-exchange fluids to achieve good heat-exchange performance. Based on the heat-exchanger having a good heat-exchange performance, the present can apply the additional hot water to heat exchange with the water at normal temperature to keep the water of the water dispenser in a predetermined temperature. Thus, the present invention has a good effect of energy conservation.

Although the invention has been described with reference to the above embodiments, it will be apparent to one of the ordinary skill in the art that modifications to the described embodiments may be made without departing from the spirit of the invention. Accordingly, the scope of the invention will be defined by the attached claims rather than by the above detailed descriptions.

What is claimed is:

1. A water dispenser, suited to adjust the temperature of water for drinking, comprising:

a first heat-exchanger, including a first inlet, a first outlet, a second inlet, a second outlet, a first guiding-channel, and a second guiding-channel, the first inlet and the first outlet are communicated with two ends of the first guiding-channel respectively, the second inlet and the second outlet are communicated with two ends of the second guiding-channel respectively, wherein the water flows into the first heat-exchanger from the first inlet, and flows out of the first heat-exchanger from the first outlet through the first guiding-channel;

a heater, one end is connected to the first outlet, another end is connected to the second inlet, the heater is suitable to heat the water flowed out of the first outlet, the heated water is suitable to flow into the first heat-exchanger from the second inlet, and flows out of the first heat-exchanger from the second outlet through second guiding-channel;

a first water-storage tank, one end is connected to the second outlet for storing the water flowed out of the second outlet;

a faucet, connected to another end of the first water-storage tank and another end of the heater respectively;

a first control valve, disposed between the heater and the faucet, wherein when the temperature of water heated by the heater is in a first predetermined temperature range, the first control valve is opened to make the water flow out of the faucet;

a second control valve, disposed between the first water-storage tank and the faucet, wherein when the temperature of water in the first water-storage tank is in a second predetermined temperature range, the second control valve is opened to make the water flow out of the faucet; and a processor, controls a open state or a closed state of the first control valve and the second control valve according to a instruction input by a user;

wherein the first heat-exchanger further including:

at least a first fin, each first fin has a first body, a first communicating-groove structure, a second communicating-groove structure, and a first connecting-groove structure, the first communicating-groove structure, the second communicating-groove structure, and the first connecting-groove structure are disposed in the first body, wherein the first communicating-groove structure has multiple first communicating-groove assemblies arranged in the first body along a disposing axis, the first connecting-groove structure has multiple first connecting-groove assemblies arranged in the first body along the disposing axis, each first communicating-groove assembly has multiple first communicating-groove units arranged in the first body along a connecting axis, each first connecting-groove assembly has multiple first connecting-groove units arranged in the first body along the connecting axis; and at least a second fin, each second fin has a second body, a third communicating-groove structure, a fourth communicating-groove structure, and a second connecting-groove structure, the third communicating-groove structure, the fourth communicating-groove structure, and the second connecting-groove structure are disposed in the second body, wherein the third communicating-groove structure has multiple third communicating-groove assemblies arranged in the second body along the disposing axis, the second connecting-groove structure has multiple second connecting-groove assemblies arranged in the second body along the disposing axis, each third communicating-groove assembly has multiple third communicating-groove units arranged in the second body along the connecting axis, each second connecting-groove assembly has multiple second connecting-groove units arranged in the second body along the connecting axis;

wherein each first fin and each second fin are connected along a assembly axis, the second connecting-groove assemblies are communicated with the first communicating-groove structure and the second communicating-groove structure, the first connecting-groove assemblies are communicated with the third communicating-groove structure and the fourth communicating-groove structure, the first communicating-groove unit of each first communicating-groove assembly is staggered with the adjacent first communicating-groove unit, the first connecting-groove unit of each first connecting-groove assembly is staggered with the adjacent first connecting-groove unit, the third communicating-groove unit of each third communicating-groove assembly is staggered with the adjacent third communicating-groove unit, the second connecting-groove unit of each second connecting-groove assembly is staggered with the adjacent second connecting-groove unit, and the first communicating-groove structure, the second connecting-groove structure, and the second communicating-groove structure constitute a first guiding-channel, the third communicating-groove structure, the first connecting-groove structure, and the fourth communicating-groove structure constitute a second guiding-channel.

2. The water dispenser as recited in claim 1, further includes a third control valve, disposed between the first water-storage tank and the second outlet for controlling the water flowed out of the second outlet to flow into the first water-storage tank, and the processor controls the operation of the third control valve.

3. The water dispenser as recited in claim 1, further includes a second water-storage tank, disposed between the heater and the first control valve for storing the water heated by the heater.

4. The water dispenser as recited in claim 3, further includes a fourth control valve and a fifth control valve, the fourth control valve is disposed between the heater and the first inlet for controlling the water to flow into at least one of the heater and the first heat-exchanger, and the processor controls the operation of the fourth control valve, the fifth control valve is disposed between the heater and the second water-storage tank for controlling the water heated by the heater to flow into at least one of the second water-storage tank and the second inlet, and the processor controls the operation of the fifth control valve.

5. The water dispenser as recited in claim 1, further includes a second heat-exchanger and a cooler, the second heat-exchanger is disposed between the first water-storage tank and the second control valve, wherein the second heat-exchanger includes a third inlet, a third outlet, a fourth inlet, a fourth outlet, a third guiding-channel, and a fourth guiding-channel, the third inlet and the third outlet are communicated with two ends of the third guiding-channel, the fourth inlet and the fourth outlet are communicated with two ends of the fourth guiding-channel, the water in the first water-storage tank flows into the second heat-exchanger from the third inlet, and flow out of the second heat-exchanger from the third outlet, and the fourth inlet is connected to one end of the cooler, the fourth outlet is connected to another end of the cooler.

6. The water dispenser as recited in claim 1, further includes a water filter, a first pump, a second pump, and a third pump, the first pump is disposed between the first outlet and the heater for driving the water flowed out of the first outlet flow into the heater, the second pump is disposed between the first water-storage tank and the faucet for driving the water in the first water-storage tank flow to the faucet, the third pump is disposed between the second heat-exchanger and the cooler for driving a cooling fluid in the cooler flow to the second heat-exchanger, and the processor controls the operation of the first pump, the second pump, and the third pump, the water filter is used to filter the water, and the filtered water flows into the first heat-exchanger from the first inlet.

7. The water dispenser as recited in claim 1, wherein the first heat-exchanger further includes a third fin and a fourth fin, the third fin and the fourth fin are disposed in two sides of the assembly of the first fin and the second fin along the assembly axis respectively, the third fin has a first through hole and a third through hole, the fourth fin has a second through hole and a fourth through hole, the projection area of the first through hole and the third through hole of the third fin in the fourth fin is not overlapped with the second through hole and the fourth through hole, the first through hole and the third through hole are connected to two ends of the first guiding-channel, the first through hole is connected to the first inlet, the third through hole is connected to the first outlet, the second through hole and the fourth through hole are connected to two ends of the second guiding-channel, the second through hole is connected to the second inlet, the fourth through hole is connected to the second outlet, and the first through hole is communicated with the first communicating-groove structure, the third through hole is communicated with the second communicating-groove structure, the second through hole is communicated with the third communicating-groove structure, the fourth through hole is communicated with the fourth communicating-groove structure, the second fin is an inverted state of the first fin, the fourth fin is an inverted state of the third fin.

8. The water dispenser as recited in claim 1, wherein one end of each second connecting-groove assembly of the second fin is overlapped with the first communicating-groove structure of the adjacent first fin along the connecting axis, the other end of each second connecting-groove assembly is overlapped with the second communicating-groove structure of the first fin, one end of each first connecting-groove assembly of the first fin is overlapped with the third communicating-groove structure of the adjacent second fin along the connecting axis, the other end of each first connecting-groove assembly is overlapped with the fourth communicating-groove structure of the second fin.

9. The water dispenser as recited in claim 8, wherein one end of the second connecting-groove unit of the second fin is overlapped with one end of the first communicating-groove unit of the adjacent first fin, the other end of the second connecting-groove unit is overlapped with one end of another first communicating-groove unit of the first fin or the second communicating-groove structure of the first fin, one end of the first connecting-groove unit of the first fin is overlapped with one end of the third communicating-groove unit of the adjacent second fin, the other end of the first connecting-groove unit is overlapped with one end of another third communicating-groove unit of the second fin or the fourth communicating-groove structure of the second fin, the two first communicating-groove units overlapped with the second connecting-groove unit are arranged in the first body along the connecting axis closely, and the two third communicating-groove units overlapped with the first connecting-groove unit are arranged in the second body along the connecting axis closely.

10. The water dispenser as recited in claim 1, wherein the second communicating-groove structure has multiple second communicating-groove units arranged in the first body along the disposing axis, each second communicating-groove unit is arranged in one side of the corresponding first communicating-groove assembly along the connecting axis, the fourth communicating-groove structure has multiple fourth communicating-groove units arranged in the second body along the disposing axis, each fourth communicating-groove unit is arranged in one side of the corresponding third communicating-groove assembly along the connecting axis.

11. The water dispenser as recited in claim 1, wherein the first communicating-groove structure further includes a first mainstream channel, each first communicating-groove assembly constitutes to a tributary channel connected with the first mainstream channel along the connecting axis, the first connecting-groove structure further includes a second mainstream channel, each first connecting-groove assembly constitutes to another tributary channel connected with the second mainstream channel along the connecting axis, the third communicating-groove structure further includes a third mainstream channel, each third communicating-groove assembly constitutes to another tributary channel connected with the third mainstream channel along the connecting axis, the second connecting-groove structure further includes a fourth mainstream channel, each second connecting-groove assembly is connected with the fourth mainstream channel along the connecting axis, the first mainstream channel and the fourth mainstream channel are communicated with each other, the third mainstream channel and the second mainstream channel are communicated with each other.

12. The water dispenser as recited in claim 11, wherein the first communicating-groove structure, the first connecting-groove structure, the third communicating-groove structure, and the second connecting-groove structure are similar to the "claw" type structure or the "E" type structure, the first communicating-groove structure and the first connecting-groove structure are embedded in the first body, the third communicating-groove structure and the second connecting-groove structure are embedded in the first body, the second communicating-groove structure is disposed between the second mainstream channel and the first communicating-groove structure, the fourth communicating-groove structure is disposed between the fourth mainstream channel and the third communicating-groove structure.

* * * * *